US009324515B2

(12) United States Patent
Krumpelman et al.

(10) Patent No.: US 9,324,515 B2
(45) Date of Patent: Apr. 26, 2016

(54) TOUCHSURFACE ASSEMBLY UTILIZING MAGNETICALLY ENABLED HINGE

(71) Applicant: SYNAPTICS INCORPORATED, San Jose, CA (US)

(72) Inventors: Douglas M. Krumpelman, Hayden, ID (US); Cody G. Peterson, Coeur d'Alene, ID (US)

(73) Assignee: Synaptics Incorporated, San Jose, CA (US)

( * ) Notice: Subject to any disclaimer, the term of this patent is extended or adjusted under 35 U.S.C. 154(b) by 156 days.

(21) Appl. No.: 13/960,083

(22) Filed: Aug. 6, 2013

(65) Prior Publication Data

US 2014/0034471 A1 Feb. 6, 2014

Related U.S. Application Data

(60) Provisional application No. 61/680,248, filed on Aug. 6, 2012, provisional application No. 61/815,813, filed on Apr. 25, 2013.

(51) Int. Cl.
*H01H 9/26* (2006.01)
*H01H 13/72* (2006.01)
(Continued)

(52) U.S. Cl.
CPC ..... *H01H 13/85* (2013.01); *H01H 13/7065* (2013.01); *H01H 2221/04* (2013.01); *H01H 2221/058* (2013.01); *H01H 2221/07* (2013.01)

(58) Field of Classification Search
CPC ... H01H 13/70; H01H 23/00; H01H 2013/00; H01H 2021/00; H01H 2036/00; H01H 2036/0086; H01H 2036/0093; H01H 2205/00; H01H 2205/004; H01H 2205/01; H01H 2205/016; H01H 2221/04; H01H 2237/004; H01H 9/26; H01H 13/72; H01H 13/76; H01H 3/00; H01H 3/02; H01H 3/04; H01H 3/12; H01H 5/02; H01H 9/02; H01H 13/00; H01H 13/04; H01H 13/10; H01H 13/14; H01H 13/20; H01H 13/50; H01H 13/86; H01H 21/04; H01H 21/36; H01H 21/54; H01H 2013/50; H01H 2215/042; H01H 2215/05; H01H 2215/052
See application file for complete search history.

(56) References Cited

U.S. PATENT DOCUMENTS 3,800,104 A 3/1974 Lien et al.
3,886,341 A 5/1975 Forrest
(Continued)

FOREIGN PATENT DOCUMENTS

CN 2762268 Y 3/2006
CN 102035525 A 4/2011
(Continued)

OTHER PUBLICATIONS

"Elastomers: Powerful Polymer", Retrieved from <http://appliancedesign.com/copyright/>, (Jun. 2006),5 pages.
(Continued)

*Primary Examiner* — Renee S Luebke
*Assistant Examiner* — Anthony R. Jimenez
(74) *Attorney, Agent, or Firm* — Osha Liang LLP

(57) ABSTRACT

Methods and apparatus for a touchsurface assembly such as a key assembly are described. The touchsurface assembly includes a base, a keycap and a magnet physically coupled to the base near to the keycap. A keycap coupler has a first portion magnetically attracted to the magnet and a second portion cantilevered from the magnet to support the keycap in an unpressed position. When a press force applied to the keycap overcomes a magnetic force pulling the keycap coupler toward the magnet, the keycap coupler pivots away from the magnet to allow the keycap to move toward a pressed position.

20 Claims, 15 Drawing Sheets

(51) Int. Cl.

| | |
|---|---|
| ***H01H 13/76*** | (2006.01) |
| ***H01H 13/85*** | (2006.01) |
| ***H01H 13/7065*** | (2006.01) |

(56) References Cited

U.S. PATENT DOCUMENTS

| | | | |
|---|---|---|---|
| 3,938,642 | A | 2/1976 | Van Rumpt et al. |
| 4,039,068 | A | 8/1977 | Giorza et al. |
| 4,056,701 | A | 11/1977 | Weber |
| 4,265,557 | A | 5/1981 | Runge |
| 4,269,521 | A | 5/1981 | Longrod |
| 4,294,555 | A | 10/1981 | Galaske et al. |
| 4,315,114 | A | 2/1982 | Monti, Jr. |
| 4,326,195 | A | 4/1982 | Seki et al. |
| 4,334,280 | A | 6/1982 | Mcdonald |
| 4,343,557 | A | 8/1982 | DuRoss et al. |
| 4,403,123 | A | 9/1983 | Shek |
| 4,480,162 | A | 10/1984 | Greenwood |
| D278,239 | S | 4/1985 | Felix et al. |
| D284,574 | S | 7/1986 | Fischer |
| D292,801 | S | 11/1987 | Davis et al. |
| 4,735,520 | A | 4/1988 | Suzuki et al. |
| 4,786,766 | A | 11/1988 | Kobayashi |
| 4,885,565 | A | 12/1989 | Embach |
| D312,623 | S | 12/1990 | Carter et al. |
| 5,003,140 | A | 3/1991 | Abell, Jr. et al. |
| 5,053,591 | A | 10/1991 | Theurer |
| 5,121,091 | A | 6/1992 | Fujiyama |
| 5,189,390 | A | 2/1993 | Fagard |
| 5,212,473 | A | 5/1993 | Louis |
| 5,239,152 | A | 8/1993 | Caldwell et al. |
| 5,329,278 | A | 7/1994 | Dombroski |
| 5,350,244 | A | 9/1994 | Buttner |
| 5,418,530 | A | 5/1995 | Moore et al. |
| 5,463,195 | A | 10/1995 | Watanabe et al. |
| 5,523,730 | A | 6/1996 | Van Zeeland |
| 5,569,889 | A | 10/1996 | Bruner |
| 5,575,576 | A | 11/1996 | Roysden, Jr. |
| 5,626,223 | A | 5/1997 | Lee |
| 5,666,096 | A | 9/1997 | Van Zeeland |
| 5,667,061 | A | 9/1997 | Lee |
| 5,763,842 | A | 6/1998 | Tsai et al. |
| 5,767,463 | A | 6/1998 | Gandre |
| 5,779,030 | A | 7/1998 | Ikegami et al. |
| 5,828,015 | A | 10/1998 | Coulon |
| 5,867,082 | A | 2/1999 | Van Zeeland |
| 5,902,972 | A | 5/1999 | Nestor et al. |
| 5,921,382 | A | 7/1999 | Retter |
| 5,934,454 | A | 8/1999 | Burleson et al. |
| 5,973,670 | A | 10/1999 | Barber et al. |
| 5,977,867 | A | 11/1999 | Blouin |
| 5,977,888 | A | 11/1999 | Fujita et al. |
| 5,982,304 | A | 11/1999 | Selker et al. |
| 6,039,258 | A | 3/2000 | Durbin et al. |
| 6,046,730 | A | 4/2000 | Bowen et al. |
| 6,067,081 | A | 5/2000 | Hahlganss et al. |
| 6,069,545 | A | 5/2000 | Van Zeeland |
| 6,069,552 | A | 5/2000 | Van Zeeland |
| 6,118,435 | A | 9/2000 | Fujita et al. |
| 6,130,593 | A | 10/2000 | Van Zeeland |
| 6,166,662 | A | 12/2000 | Chuang |
| 6,218,966 | B1 | 4/2001 | Goodwin et al. |
| 6,219,034 | B1 | 4/2001 | Elbing et al. |
| 6,262,646 | B1 | 7/2001 | Van Zeeland |
| 6,262,717 | B1 | 7/2001 | Donohue et al. |
| 6,305,071 | B1 | 10/2001 | Van Zeeland |
| 6,328,489 | B1 | 12/2001 | Chi-Pin |
| 6,369,692 | B1 | 4/2002 | Van Zeeland |
| 6,369,803 | B2 | 4/2002 | Brisebois et al. |
| 6,373,463 | B1 | 4/2002 | Beeks |
| 6,375,372 | B1 | 4/2002 | Tsau |
| 6,392,515 | B1 | 5/2002 | Van Zeeland et al. |
| 6,400,246 | B1 | 6/2002 | Hill et al. |
| 6,429,846 | B2 | 8/2002 | Rosenberg et al. |
| 6,430,023 | B1 | 8/2002 | Suzuki |
| 6,455,794 | B2 | 9/2002 | Sato et al. |
| 6,466,118 | B1 | 10/2002 | Van Zeeland et al. |
| 6,509,818 | B2 | 1/2003 | Van Zeeland |
| 6,542,058 | B2 | 4/2003 | Van Zeeland |
| 6,556,112 | B1 | 4/2003 | Van Zeeland et al. |
| 6,563,434 | B1 | 5/2003 | Olodort et al. |
| 6,566,616 | B1 | 5/2003 | Ha |
| 6,657,139 | B2 | 12/2003 | Hasunuma |
| 6,677,843 | B1 | 1/2004 | Monroe et al. |
| 6,693,626 | B1 | 2/2004 | Rosenberg |
| 6,723,935 | B1 | 4/2004 | Watanabe |
| 6,723,937 | B2 | 4/2004 | Englemann et al. |
| 6,750,415 | B2 | 6/2004 | Yamagami |
| 6,761,494 | B2 | 7/2004 | Hsu et al. |
| 6,819,990 | B2 | 11/2004 | Ichinose |
| 6,822,635 | B2 | 11/2004 | Shahoian et al. |
| 6,861,603 | B1 | 3/2005 | Wang |
| 6,880,994 | B2 | 4/2005 | Takahashi |
| 6,911,901 | B2 | 6/2005 | Bown |
| 6,937,124 | B1 | 8/2005 | Nakamura et al. |
| 6,939,065 | B2 | 9/2005 | Roysden, Jr. |
| 6,940,030 | B2 | 9/2005 | Takeda et al. |
| 6,962,452 | B2 | 11/2005 | Cheng |
| 6,982,617 | B2 | 1/2006 | Brilon et al. |
| D527,004 | S | 8/2006 | Yen |
| 7,106,305 | B2 | 9/2006 | Rosenberg |
| 7,113,177 | B2 | 9/2006 | Franzen |
| 7,119,798 | B2 | 10/2006 | Yoshikawa et al. |
| 7,148,789 | B2 | 12/2006 | Sadler et al. |
| 7,166,795 | B2 | 1/2007 | Lengeling |
| 7,182,691 | B1 | 2/2007 | Schena |
| 7,196,688 | B2 | 3/2007 | Schena |
| 7,215,329 | B2 | 5/2007 | Yoshikawa et al. |
| 7,224,106 | B2 | 5/2007 | Pei et al. |
| 7,227,537 | B2 | 6/2007 | Nakayama et al. |
| 7,269,484 | B2 | 9/2007 | Hein |
| 7,292,227 | B2 | 11/2007 | Fukumoto et al. |
| 7,312,791 | B2 | 12/2007 | Hoshino et al. |
| 7,324,094 | B2 | 1/2008 | Moilanen et al. |
| 7,336,266 | B2 | 2/2008 | Hayward et al. |
| 7,339,572 | B2 | 3/2008 | Schena |
| 7,342,573 | B2 | 3/2008 | Ryynaenen |
| 7,375,656 | B2 | 5/2008 | Muller et al. |
| 7,385,308 | B2 | 6/2008 | Yerdon et al. |
| 7,400,319 | B2 | 7/2008 | Nakayama et al. |
| 7,450,110 | B2 | 11/2008 | Shahoian et al. |
| 7,525,415 | B2 | 4/2009 | Yatsu et al. |
| 7,548,232 | B2 | 6/2009 | Shahoian et al. |
| 7,567,232 | B2 | 7/2009 | Rosenberg |
| 7,569,786 | B2 | 8/2009 | Spies |
| 7,573,460 | B2 | 8/2009 | Strawn et al. |
| 7,579,758 | B2 | 8/2009 | Maruyama et al. |
| 7,589,607 | B2 | 9/2009 | Rochon et al. |
| 7,592,901 | B2 | 9/2009 | Furusho |
| 7,592,999 | B2 | 9/2009 | Rosenberg et al. |
| 7,602,384 | B2 | 10/2009 | Rosenberg et al. |
| 7,607,087 | B2 | 10/2009 | Prados |
| 7,701,440 | B2 | 4/2010 | Harley |
| 7,855,715 | B1 | 12/2010 | Bowen |
| 7,868,515 | B2 | 1/2011 | Krochmal et al. |
| 7,898,440 | B2 | 3/2011 | Chen |
| 7,969,288 | B2 | 6/2011 | Braun et al. |
| 7,982,720 | B2 | 7/2011 | Rosenberg et al. |
| 8,031,181 | B2 | 10/2011 | Rosenberg et al. |
| 8,059,105 | B2 | 11/2011 | Rosenberg et al. |
| 8,094,130 | B2 | 1/2012 | Griffin et al. |
| 8,199,033 | B2 | 6/2012 | Peterson et al. |
| 8,203,531 | B2 | 6/2012 | Peterson et al. |
| 8,217,289 | B2 | 7/2012 | Liu |
| 8,222,799 | B2 | 7/2012 | Polyakov et al. |
| 8,232,969 | B2 | 7/2012 | Grant et al. |
| 8,248,277 | B2 | 8/2012 | Peterson et al. |
| 8,248,278 | B2 | 8/2012 | Schlosser et al. |
| 8,274,478 | B2 | 9/2012 | Bowen |
| 8,309,870 | B2 | 11/2012 | Peterson et al. |
| 8,310,351 | B2 | 11/2012 | Krahenbuhl et al. |
| 8,310,444 | B2 | 11/2012 | Peterson et al. |
| 8,451,426 | B2 | 5/2013 | Iino |
| 8,648,737 | B1 | 2/2014 | Bowen |

(56) References Cited

U.S. PATENT DOCUMENTS

| | | | |
|---|---|---|---|
| 8,674,941 | B2 | 3/2014 | Casparian et al. |
| 2001/0002648 | A1 | 6/2001 | Van Zeeland |
| 2002/0054060 | A1 | 5/2002 | Schena |
| 2002/0084721 | A1 | 7/2002 | Walczak |
| 2002/0149561 | A1 | 10/2002 | Fukumoto et al. |
| 2003/0067449 | A1 | 4/2003 | Yoshikawa et al. |
| 2003/0209131 | A1 | 11/2003 | Asahi |
| 2003/0210233 | A1 | 11/2003 | Frulla |
| 2004/0252104 | A1 | 12/2004 | Nakamura et al. |
| 2005/0017947 | A1 | 1/2005 | Shahoian et al. |
| 2005/0089356 | A1 | 4/2005 | Jung-Tsung |
| 2005/0157893 | A1 | 7/2005 | Pelrine et al. |
| 2005/0204906 | A1 | 9/2005 | Lengeling |
| 2005/0237309 | A1 | 10/2005 | Sharma |
| 2006/0232559 | A1 | 10/2006 | Chien et al. |
| 2006/0256075 | A1 | 11/2006 | Anastas et al. |
| 2006/0261983 | A1 | 11/2006 | Griffin et al. |
| 2007/0031097 | A1 | 2/2007 | Heikenfeld et al. |
| 2007/0080951 | A1 | 4/2007 | Maruyama et al. |
| 2007/0091070 | A1 | 4/2007 | Larsen et al. |
| 2007/0146317 | A1 | 6/2007 | Schena |
| 2007/0146334 | A1 | 6/2007 | Inokawa |
| 2007/0152974 | A1 | 7/2007 | Kim et al. |
| 2007/0165002 | A1 | 7/2007 | Wassingbo |
| 2007/0193436 | A1 | 8/2007 | Chu |
| 2007/0205988 | A1 | 9/2007 | Gloyd et al. |
| 2007/0234887 | A1 | 10/2007 | Sawada et al. |
| 2007/0234890 | A1 | 10/2007 | Yamashita |
| 2007/0236449 | A1 | 10/2007 | Lacroix et al. |
| 2007/0236450 | A1 | 10/2007 | Colgate et al. |
| 2008/0007529 | A1 | 1/2008 | Paun et al. |
| 2008/0042980 | A1 | 2/2008 | Bowen |
| 2008/0062015 | A1 | 3/2008 | Bowen |
| 2008/0083314 | A1 | 4/2008 | Hayashi et al. |
| 2008/0084384 | A1 | 4/2008 | Gregorio et al. |
| 2008/0087476 | A1 | 4/2008 | Prest et al. |
| 2008/0092720 | A1 | 4/2008 | Yamashita et al. |
| 2008/0100568 | A1 | 5/2008 | Koch et al. |
| 2008/0165127 | A1 | 7/2008 | Eom |
| 2008/0264770 | A1 | 10/2008 | Purcocks |
| 2008/0289952 | A1 | 11/2008 | Pelrine et al. |
| 2008/0302647 | A1 | 12/2008 | Villain et al. |
| 2008/0303782 | A1 | 12/2008 | Grant et al. |
| 2009/0002205 | A1 | 1/2009 | Klinghult et al. |
| 2009/0072662 | A1 | 3/2009 | Sadler et al. |
| 2009/0073128 | A1 | 3/2009 | Marsden |
| 2009/0079593 | A1 | 3/2009 | Yamakawa et al. |
| 2009/0088220 | A1 | 4/2009 | Persson |
| 2009/0128501 | A1 | 5/2009 | Lazaridis et al. |
| 2009/0178913 | A1 | 7/2009 | Peterson et al. |
| 2009/0189790 | A1 | 7/2009 | Peterson et al. |
| 2009/0189873 | A1 | 7/2009 | Peterson et al. |
| 2009/0210568 | A1 | 8/2009 | Peterson et al. |
| 2009/0231277 | A1 | 9/2009 | Peterson et al. |
| 2009/0255793 | A1 | 10/2009 | Krochmal et al. |
| 2010/0171715 | A1 | 7/2010 | Peterson et al. |
| 2010/0231423 | A1 | 9/2010 | Yang |
| 2010/0245231 | A1 | 9/2010 | Aramaki |
| 2010/0253629 | A1 | 10/2010 | Orsley |
| 2010/0259481 | A1 | 10/2010 | Oh |
| 2010/0309130 | A1 | 12/2010 | Zhao et al. |
| 2010/0321301 | A1 | 12/2010 | Casparian et al. |
| 2010/0328251 | A1 | 12/2010 | Sinclair |
| 2011/0025607 | A1 | 2/2011 | Bowen |
| 2011/0056818 | A1 | 3/2011 | Maruyama et al. |
| 2011/0095919 | A1 | 4/2011 | Ostermoller et al. |
| 2011/0096013 | A1 | 4/2011 | Krumpelman et al. |
| 2011/0128239 | A1 | 6/2011 | Polyakov et al. |
| 2011/0203912 | A1 | 8/2011 | Niu |
| 2011/0205161 | A1 | 8/2011 | Myers et al. |
| 2011/0227762 | A1 | 9/2011 | Bowen |
| 2011/0227872 | A1 | 9/2011 | Huska et al. |
| 2011/0234494 | A1 | 9/2011 | Peterson et al. |
| 2012/0019445 | A1 | 1/2012 | Liu |
| 2012/0043191 | A1 | 2/2012 | Kessler et al. |
| 2012/0092263 | A1 | 4/2012 | Peterson et al. |
| 2012/0119996 | A1 | 5/2012 | Wu et al. |
| 2012/0169603 | A1 | 7/2012 | Peterson et al. |
| 2012/0268384 | A1 | 10/2012 | Peterson et al. |
| 2012/0299832 | A1 | 11/2012 | Peterson et al. |
| 2013/0082932 | A1 | 4/2013 | Gluckstad et al. |
| 2013/0093681 | A1 | 4/2013 | Hsu |
| 2013/0135207 | A1 | 5/2013 | Neil et al. |
| 2013/0314325 | A1 | 11/2013 | Furukawa |
| 2013/0342494 | A1 | 12/2013 | Feng |
| 2014/0001021 | A1 | 1/2014 | Zhang |
| 2014/0034468 | A1 | 2/2014 | Krumpelman et al. |
| 2014/0055363 | A1 | 2/2014 | Meierling et al. |

FOREIGN PATENT DOCUMENTS

| | | | |
|---|---|---|---|
| CN | 202150389 | U | 2/2012 |
| CN | 102832921 | A | 12/2012 |
| CN | 202694270 | U | 1/2013 |
| DE | 19704253 | A | 8/1998 |
| DE | 10126670 | A1 | 12/2002 |
| DE | 2005002417 | A | 4/2005 |
| DE | 2004005501 | A | 8/2005 |
| EP | 0278916 | A | 8/1988 |
| EP | 1548776 | A | 6/2005 |
| EP | 2287873 | A | 2/2011 |
| JP | H10063259 | A | 3/1998 |
| JP | 2000348562 | A | 12/2000 |
| JP | 2007173087 | A | 7/2007 |
| JP | 2011233406 | A | 11/2011 |
| WO | WO 2007114631 | A2 * | 10/2007 |

OTHER PUBLICATIONS

"Haptic Touch Technology", Pacinian,(Nov. 2007),2 pages.

"Haptics: Learning Through Touch", Retrieved from <http://ced.ncsu.edu/nanoscale/haptics.htm>, (2004),5 pages.

"International Search Report and Written Opinion", Application No. PCT/US2010/020380, (Apr. 12, 2010),10 pages.

"Nanoactuators Based on Electrostatic Forces on Dielectrics", Retrieved from <http://www.nasatech.com/Briefs/Apr05/NP030747.html>on Nov. 28, 2005, NASA's Jet Propulsion Laboratory, Pasadena, CA,4 pages.

New SRI International sSpin-Off, Artificial Muscle, Inc., Secure Series a Funding from Leading VC Firms, Retrieved from <http://www.sri.com/news/releases/05-03-04.html> on Jan. 30, 2008, SRI International Spin Offs Artificial Muscle, Inc,(May 2004),2 pages.

"Non-Final Office Action mailed Dec. 9, 2011", U.S. Appl. No. 12/580,002, 21 pages.

"Proposed Experiment Protocol and Details", Retrieved from <http://bdml.stanford.edu/twiki/bin/view/Haptics/ProposedExperiomentPr-otocolAndDetails>, 5 pages.

"Tactile Perception and Design", Retrieved from http://www.tireesias.org/reports.tpd2.htm on Apr. 4, 2006, 10 pages.

"Touch and Haptics", 2004 IEEE/ RSJ International Conference on Intelligent Robots and Systems, (Sep. 28, 2004),32 pages.

"Touch-Hapsys", Retrieved from <http://www.touch-hapsys.org>, 2 pages.

Ashley, Steven "Artificial Muscles", Scientific American, Available at <www.sciam.com>,(Oct. 2003),pp. 53-59.

Bar-Cohen, Y. "Electroactive Polymer (EAP) Actuators as Artificial Muscles—Reality, Potential and Challenges", SPIE Press, (Mar. 18, 2004),pp. 26 and 548-550.

Bar-Cohen, Yoseph "Electric Flex", IEEE Spectrum Online, (Jun. 2004),6 pages.

Bar-Cohen, Yoseph "Electroactive Polymers as Artificial Muscles—Capabilities, Potentials and Challenges", Robotics 2000, Available at <www.spaceandrobotics>,(Feb. 28-Mar. 2, 2000),pp. 1-8.

Bar-Cohen, Yoseph "Electroactive Polymers", Retrieved from <http://electrochem.cwru.edu/ed/encycl/>, Electrochemistry Encyclopedia,(Dec. 2004),7 pages.

Bar-Cohen, Yoseph "Low Mass Muscle Actuators (LoMMAs)", Telerobotic Task Sponsored by NASA HQ, Code S, (Oct. 23, 1997),18 pages.

(56) References Cited

OTHER PUBLICATIONS

Bar-Cohen, Yoseph "Worldwide Electroactive Polymers", (Artificial Muscles) Newsletter, vol. 7, No. 2, Available at <http://eap.jpl.nasa.gov>,(Dec. 2005),pp. 1-16.
Bar-Cohen, Yoseph et al., "Enabling Novel Planetary and Terrestrial Mechanisms Using Electroactive Materials at the JPL's NDEAA Lab", Retrieved from http://ndeaajpl.nasa.gov>, pp. 1-6.
Bark, Karlin "Functional Prototype I", Retrieved from <http://bdml.stanford.edu/twiki/bin/view/Haptics/FunctionalPrototypel?-skin=print.pattern>, (Aug. 9, 2005),3 pages.
Beavers, Alex "Basic Concepts for Commercial Applications of Electroactive Polymer Artificial Muscle", Artificial Muscle Incorporated, Menlo Park, CA,10 pages.
Bicchi, Antonio et al., "Haptic Illusions Induced by the Tactile Flow", Interdepartmental Research Centre "E. Piaggo", University of Pisa,12 pages.
Bifano, Thomas "Parallel Plate Electrostatic Actuation for High-Resolution Deformable Mirrors", Boston University, (Aug. 19, 2004),35 pages.
Poupyrev, Ivan, et al., "TouchEngine: A Tactile Display for Handheld Devices", 2002, 2 pages.
Biggs, James "Some Useful Information for Tactile Display Design", IEEE Transactions on Man-Machine Systems, vol. 11, No. 1,(1970),pp. 19-24.
Carpi, Federico et al., "Dielectric Elastomers as Electromechanical Transducers: Fundamentals, Materials, Devices, Models and Applications of an Emerging Elecrotactive Polymer Technology", Elsevier Ltd., (2008),12 pages.
Fontaine, Ebraheem "A Laboratory Demonstration of a Parallel Robotic Mechanism", Massachusetts Institute of Technology,(Jun. 2002),pp. 1 -14.
Fukumoto, Masaki, et al, "Active Click: Tactile Feedback for Touch Panels", NTT DoCoMo Multimedia Labs, Mar. 31, 2001, 2 pages.
Gorinevsky, Dimitry "Adaptive membrane for large lightweight space telescopes", SPIE Astronomical Telescopes and Instrumentation,(2002),pp. 1-9.
Hayward, Vincent et al., "Tactile Display Device Using Distributed Lateral Skin Stretch", Proceedings of the Haptic Interfaces for Virtual Environment and Teleoperator Systems Symposium, ASME International Mechanical Engineering Congress & Exposition,(2000),pp. 1309-1314.
Hollis, Ralph "Haptics", Berkshire Encyclopedia of Human-Computer Interaction, Berkshire Publishing Group,(2004), pp. 311-316.
Jager, Edwin et al., "Microfabricating Conjugated Polymer Actuators", Science Magazine, vol. 290, www.sciencemag.org,(Nov. 24, 2000),pp. 1540-1544.
Jones, Gail et al., "A Comparison of Learning with Haptic and Visual Modalities", National Science Foundation REC-0087389,pp. 1-20.
Jones, Lynette "Human Factors and Haptic Interfaces", Department of Mechanical Engineering, Massachusetts Institute of Technology,40 pages.
Jungmann, M., et al, Miniaturised Electrostatic Tactile Display with High Structural Compliance, 2002, 6 pages.
Kajimoto, Hiroyuki et al., "Electro-Tactile Display with Tactile Primary Color Approach", Graduate School of Information and Technology, The University of Tokyo,2 pages.
Mackenzie, Scott, et al, "The Tactile Touchpad", 1997, 5 pages.
Mackenzie, Scott, et al., "A Comparison of Three Selection Techniques for Touchpads", Proceedings of the CHI'98 Conference on Human Factors in Computing Systems, pp. 336-343 New York 1998.
Mok Ha, Soon et al., "Interpenetrating Polymer Networks for High-Performance Electroelastomer Artificial Muscles", Department of Materials Science and Engineering, UCLA,pp. 1-19.
Non-Final Office Action mailed Feb. 13, 2009, U.S. Appl. No. 11/945,879.
Odell, D.L. et al., "MicroRobot Conveyance and Propulsion System Using Comb Drive and Parallel Plate Actuators: The ScuttleBot", UC Berkley,4 pages.
O'Halloran, A et al., "Materials and Technologies for Artificial Muscle: A Review for the Mechatronic Muscle Project", Topics in Bio-Mechanical Engineering, Chapter 7, Department of Electronic Engineering, National University of Ireland Galway,(2004),pp. 184-215.
Oniszczak, Aleks, "VersaPad Driver Plus Pack", 1999, 3 pages.
Pasquero, Jerome "Stimulation of the Fingertip by Lateral Skin Strech", Retrieved from <http://www.cim.mcgill.ca/.aboutlay/index.sub.--files/research.htm&gt- ;, 5 pages.
Pasquero, Jerome "Stress: A Tactile Display Using Lateral Skin Stretch", Department of Electrical and Computer Engineering McGill University, Montreal,(Oct. 2003),75 pages.
Pasquero, Jerome "Survey on Communication Through Touch", Technical Report: TR-CIM 06.04, Center for Intelligent Machines Department of Electrical and Computer Engineering,(Jul. 2006),pp. 1-27.
Pasquero, Jerome "Tactile Display Survey", Technical Report TR-CIM 06.04,6 pages.
Pei, Qibing et al., "Multiple-Degrees-of-Freedom Electroelastomer Roll Actuators", SRI International Institute of Physics Publishing, (2004),pp. N86-N92.
Poupyrev, Ivan, et al., "Tactile Interfaces for Small Touch Screens", 2003, 4 pages.
Raisamo, Roope "Tactile User Interfaces", New Interaction Techniques,(Aug. 2, 2001),30 pages.
Seeger, Joseph et al., "Dynamics and Control of Parallel-Plate Actuators Beyond the Electrostatic Instability", Transducers '99 The 10th International Conference on Solid State Sensors and Actuators, (Jun. 1999),pp. 474-477.
Sommer-Larsen, Peter "Artificial Muscles", Rise National Laboratory, Condensed Matter Physics and Chemistry Department,3 pages.
Spires, Shelby "Artificial Strongman", Smart Business: For The New Economy, (Nov. 2000),1 page.
Srinivasan, Mandayam A., et al, "Role of Skin Biomechanics in Mechanoreceptor Response", Retrieved from <http://touchlab.mit.edu/oldresearch/currentworlk/humanhaptics/roleofsk-inbiomechanicsl> on Dec. 20, 2007, MIT Touch Lab, (Dec. 20, 2007),pp. 1-13.
Supplemental Notice of Allowance mailed May 20, 2010, U.S. Appl. No. 11/945,879, 5 pages.
Wagner, Christopher et al., "Integrating Tactile and Force Feedback with Finite Element Models", Division of Engineering and Applied Sciences, Harvard University,6 pages.
Wagstaff, Jeremy, "A Passion for the Keys", The Wall Street Journal Online, Nov. 23, 2007, 3 pages, retrieved from the Internet at online.wsj.com/article_print/SB119578337324301744.html.
Wing, Alan et al., "Multidimensional Haptics Preliminary Report", Retrieved from <http://www.touch-hapsys.org>, (Sep. 21, 2003),pp. 1-125.
Wingert, Andreas et al., "On the Kinematics of Parallel Mechanisms with Bio-stable Polymer Actuators", Department of Mechanical Engineering, Massachusetts Institute of Technology Cambridge,8 pages.
Wu, Xingtao et al., "A Generalized Capacitance-Based Model for Electrostatic Micro-Actuators", Department of Physics, New Jersey Institute of Technology, Newark, NJ, 07102-1982 Department of Mechanical Engineering, Columbia University, NY 10027, pp. 1-23.
Yang, Gi-Hun, "Novel Haptic Mouse System for Holistic Haptic Display and Potential of Vibrotactile Stimulation", Human-Robot Interaction Research Center, Korea Advanced Institute of Science and Technology, 2005, 17 pages.
Zou, Jun et al., "Design of a Wide Turning Range Micromachined Turnable Capacitor for Wireless Communications", First IEEE Electro/Information Technology Conference, Jun. 8-11, Chicago, IL, 2000, 6 pages.
Non-Final Office Action mailed May 14, 2012, U.S. Appl. No. 13/323,292, 19 pages.
Final Office Action mailed Aug. 1, 2012 for U.S. Appl. No. 12/580,002, 23 pages.
International Preliminary Report on Patentability issued in PCT/US2013/053798 mailed Feb. 19, 2015 (8 pages).
Written Opinion of the International Searching Authority issued in PCT/US2013/053798 mailed Dec. 2, 2013 (6 pages).

* cited by examiner

TOUCHSURFACE ASSEMBLY UTILIZING MAGNETICALLY ENABLED HINGE

RELATED APPLICATION(S)

This application claims the benefit of U.S. Provisional Application No. 61/680,248 filed Aug. 6, 2012. This application also claims the benefit of U.S. Provisional Application No. 61/815,813 filed Apr. 25, 2013.

FIELD OF THE INVENTION

This invention generally relates to electronic devices.

BACKGROUND OF THE INVENTION

Pressable touchsurfaces (touch surfaces which can be pressed) are widely used in a variety of input devices, including as the surfaces of keys or buttons for keypads or keyboards, and as the surfaces of touch pads or touch screens. It is desirable to improve the usability of these input systems.

FIG. 2 shows a graph 200 of an example tactile response curve associated with the "snapover" haptic response found in many keys enabled with metal snap domes or rubber domes. Specifically, graph 200 relates force applied to the user by a touchsurface of the key (a reaction force resisting a press of the key by the user) and the amount of key displacement (movement relative to its unpressed position). The force applied to the user may be a total force or the portion of the total force along a particular direction such as the positive or negative press direction. Similarly, the amount of key travel may be a total amount of key displacement or the portion along a particular direction such as the positive or negative press direction.

The force curve 210 shows four key press states 212, 214, 216, 218 symbolized with depictions of four rubber domes at varying amounts of key displacement. The key is in the "unpressed" state 212 when no press force is applied to the key and the key is in the unpressed position (i.e., "ready" position). In response to press input, the key initially responds with some key displacement and increasing reaction force applied to the user. The reaction force increases with the amount of key displacement until it reaches a local maximum "peak force" $F_1$ in the "peak" state 214. In the peak state 214, the metal snap dome is about to snap or the rubber dome is about to collapse. The key is in the "contact" state 216 when the keycap, snap dome or rubber dome, or other key component moved with the keycap makes initial physical contact with the base of the key (or a component attached to the base) with the local minimum "contact force" $F_2$. The key is in the "bottom" state 218 when the key has travelled past the "contact" state and is mechanically bottoming out, such as by compressing the rubber dome in keys enabled by rubber domes.

A snapover response is defined by the shape of the reaction force curve—affected by variables such as the rate of change, where it peaks and troughs, and the associated magnitudes. The difference between the peak force $F_1$ and the contact force $F_2$ can be termed the "snap." The "snap ratio" can be determined as $(F_1-F_2)/F_1$ (or as $100*(F_1-F_2)/F_1$, if a percent-type measure is desired).

BRIEF SUMMARY OF THE INVENTION

Methods and apparatus for a touchsurface assembly such as a key assembly are described. The touchsurface assembly includes a base, a keycap and a magnet physically coupled to the base near to the keycap. A keycap coupler has a first portion magnetically attracted to the magnet and a second portion cantilevered from the magnet to support the keycap in an unpressed position. When a press force applied to the keycap overcomes a magnetic force pulling the keycap coupler toward the magnet, the keycap coupler pivots away from the magnet to allow the keycap to move toward a pressed position.

BRIEF DESCRIPTION OF DRAWINGS

Example embodiments of the present invention will hereinafter be described in conjunction with the appended drawings which are not to scale unless otherwise noted, where like designations denote like elements, and.

DETAILED DESCRIPTION OF THE INVENTION

The following detailed description is merely exemplary in nature and is not intended to limit the invention or the application and uses of the invention.

Various embodiments of the present invention provide input devices and methods that facilitate improved usability, thinner devices, easier assembly, lower cost, more flexible industrial design, or a combination thereof. These input devices and methods involve pressable touchsurfaces that may be incorporated in any number of devices. As some examples, pressable touchsurfaces may be implemented as surfaces of touchpads, touchscreens, keys, buttons, and the surfaces of any other appropriate input device. Thus, some non-limiting examples of devices that may incorporate pressable touchsurfaces include personal computers of all sizes and shapes, such as desktop computers, laptop computers, netbooks, ultrabooks, tablets, e-book readers, personal digital assistants (PDAs), and cellular phones including smart phones. Additional example devices include data input devices (including remote controls, integrated keyboards or keypads such as those within portable computers, or peripheral keyboards or keypads such as those found in tablet covers or stand-alone keyboards, control panels, and computer mice), and data output devices (including display screens and printers). Other examples include remote terminals, kiosks, point-of-sale devices, video game machines (e.g., video game consoles, portable gaming devices, and the like) and media devices (including recorders, editors, and players such as televisions, set-top boxes, music players, digital photo frames, and digital cameras).

The discussion herein focuses largely on rectangular touchsurfaces. However, the touchsurfaces for many embodiments can comprises other shapes. Example shapes include triangles, quadrilaterals, pentagons, polygons with other numbers of sides, shapes similar to polygons with rounded corners or nonlinear sides, shapes with curves, elongated or circular ellipses circles, combinations shapes with portions of any of the above shapes, non-planar shapes with concave or convex features, and any other appropriate shape.

In addition, although the discussion herein focuses largely on the touchsurfaces as being atop rigid bodies that undergo rigid body motion, some embodiments may comprise touchsurfaces atop pliant bodies that deform. "Rigid body motion" is used herein to indicate motion dominated by translation or rotation of the entire body, where the deformation of the body is negligible. Thus, the change in distance between any two given points of the touchsurface is much smaller than an associated amount of translation or rotation of the body.

Also, in various implementations, pressable touchsurfaces may comprise opaque portions that block light passage, translucent or transparent portions that allow light passage, or both.

Figure 1:
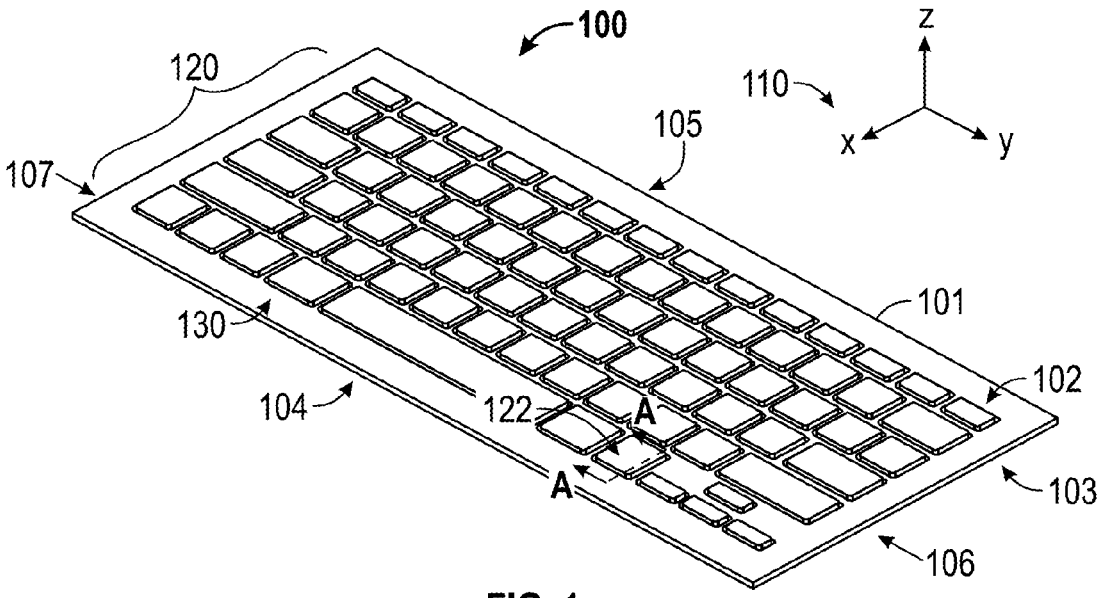
FIG. 1 shows an example keyboard that incorporates one or more implementations of key-based touchsurfaces configured in accordance with the techniques described herein.

FIG. 1 shows an example keyboard 100 that incorporates a plurality of (two or more) pressable key-based touchsurfaces configured in accordance with the techniques described herein. The example keyboard 100 comprises rows of keys 120 of varying sizes surrounded by a keyboard bezel 130. Keyboard 100 has a QWERTY layout, even though the keys 120 are not thus labeled in FIG. 1. Other keyboard embodiments may comprise different physical key shapes, key sizes, key locations or orientations, or different key layouts such as DVORAK layouts or layouts designed for use with special applications or non-English languages. In some embodiments, the keys 120 comprise keycaps that are rigid bodies, such as rigid rectangular bodies having greater width and breadth than depth (depth being in the Z direction as explained below). Also, other keyboard embodiments may comprise a single pressable key-based touchsurface configured in accordance with the techniques described herein, such that the other keys of these other keyboard embodiments are configured with other techniques.

Orientation terminology is introduced here in connection with FIG. 1, but is generally applicable to the other discussions herein and the other figures unless noted otherwise. This terminology introduction also includes directions associated with an arbitrary Cartesian coordinate system. The arrows 110 indicate the positive directions of the Cartesian coordinate system, but do not indicate an origin for the coordinate system. Definition of the origin will not be needed to appreciate the technology discussed herein.

The face of keyboard 100 including the exposed touchsurfaces configured to be pressed by users is referred to as the "top" 102 of the keyboard 100 herein. Using the Cartesian coordinate directions indicated by the arrows 110, the top 102 of the keyboard 100 is in the positive-Z direction relative to the bottom 103 of the keyboard 100. The part of the keyboard 100 that is typically closer to the body of a user when the keyboard 100 is in use atop a table top is referred to as the "front" 104 of the keyboard 100. In a QWERTY layout, the front 104 of the keyboard 100 is closer to the space bar and further from the alphanumeric keys. Using the Cartesian coordinate directions indicated by the arrows 110, the front 104 of the keyboard 100 is in the positive-X direction relative to the back 105 of the keyboard 100. In a typical use orientation where the top 102 of the keyboard 100 is facing upwards and the front 104 of the keyboard 100 is facing towards the user, the "right side" 106 of the keyboard 100 is to the right of a user. Using the Cartesian coordinate directions indicated by the arrows 110, the right side 106 of the keyboard 100 is in the positive-Y direction relative to the "left side" 107 of the keyboard 100. With the top 102, front 104, and right side 106 thus defined, the "bottom" 103, "back" 105, and "left side" 107 of the keyboard 100 are also defined.

Using this terminology, the press direction for the keyboard 100 is in the negative-Z direction, or vertically downwards toward the bottom of the keyboard 100. The X and Y directions are orthogonal to each other and to the press direction. Combinations of the X and Y directions can define an infinite number of additional lateral directions orthogonal to the press direction. Thus, example lateral directions include the X direction (positive and negative), the Y direction (positive and negative), and combination lateral directions with components in both the X and Y directions but not the Z direction. Motion components in any of these lateral directions is sometimes referred herein as "planar," since such lateral motion components can be considered to be in a plane orthogonal to the press direction.

Some or all of the keys of the keyboard 100 are configured to move between respective unpressed and pressed positions that are spaced in the press direction and in a lateral direction orthogonal to the press direction. That is, the touchsurfaces of these keys exhibit motion having components in the negative Z-direction and in a lateral direction. In the examples described herein, the lateral component is usually in the positive X-direction or in the negative X-direction for ease of understanding. However, in various embodiments, and with reorientation of select key elements as appropriate, the lateral separation between the unpressed and the pressed positions may be solely in the positive or negative X-direction, solely in the positive or negative Y-direction, or in a combination with components in both the X and Y directions.

Thus, these keys of the keyboard 100 can be described as exhibiting "diagonal" motion from the unpressed to the pressed position. This diagonal motion is a motion including both a "Z" (or vertical) translation component and a lateral (or planar) translation component. Since this planar translation occurs with the vertical travel of the touchsurface, it may be called "planar translational responsiveness to vertical travel" of the touchsurface, or "vertical-lateral travel."

Some embodiments of the keyboard 100 comprise keyboards with leveled keys that remain, when pressed during normal use, substantially level in orientation through their respective vertical-lateral travels. That is, the keycaps of these leveled keys (and thus the touchsurfaces of these keys) exhibit little or no rotation along any axes in response to presses that occur during normal use. Thus, there is little or no roll, pitch, and yaw of the keycap and the associated touchsurfaces remain relatively level and substantially in the same orientation during their motion from the unpressed position to the pressed position.

In various embodiments, the lateral motion associated with the vertical-lateral travel can improve the tactile feel of the key by increasing the total key travel for a given amount of vertical travel in the press direction. In various embodiments, the vertical-lateral travel also enhances tactile feel by imparting to users the perception that the touchsurface has travelled a larger vertical distance than actually travelled. For example, the lateral component of vertical-lateral travel may apply tangential friction forces to the skin of a finger pad in contact with the touchsurface, and cause deformation of the skin and finger pad that the user perceives as additional vertical travel. This then creates a tactile illusion of greater vertical travel. In some embodiments, returning the key from the pressed to the unpressed position on the return stroke also involves simulating greater vertical travel using lateral motion.

To enable the keys 120 of the keyboard 100 with vertical-lateral travel, the keys 120 are parts of key assemblies each comprising mechanisms for effecting planar translation, readying the key 120 by holding the associated keycap in the unpressed position, and returning the key 120 to the unpressed position. Some embodiments further comprise mechanisms for leveling keycaps. Some embodiments achieve these functions with a separate mechanism for each function, while some embodiments achieve two or more of these functions using a same mechanism. For example, a "biasing" mechanism may provide the readying function, the returning function, or both the readying and returning functions. Mechanisms which provide both readying and returning functions are referred to herein as "ready/return" mechanisms. As another example, a leveling/planar-translation-effecting mechanisms may level and effect planar translation. As further examples, other combinations of functions may be provided by a same mechanism.

The keyboard 100 may use any appropriate technology for detecting presses of the keys of the keyboard 100. For example, the keyboard 100 may employ a key switch matrix based on conventional resistive membrane switch technology. The key switch matrix may be located under the keys 120 and configured to generate a signal to indicate a key press when a key 120 is pressed. Alternatively, the example keyboard 100 may employ other key press detection technology to detect any changes associated with the fine or gross change in position or motion of a key 120. Example key press detection technologies include various capacitive, resistive, inductive, magnetic, force or pressure, linear or angular strain or displacement, temperature, aural, ultrasonic, optical, and other suitable techniques. With many of these technologies, one or more preset or variable thresholds may be defined for identifying presses and releases.

As a specific example, capacitive sensor electrodes may be disposed under the touchsurfaces, and detect changes in capacitance resulting from changes in press states of touchsurfaces. The capacitive sensor electrodes may utilize "self capacitance" (or "absolute capacitance") sensing methods based on changes in the capacitive coupling between the sensor electrodes and the touchsurface. In some embodiments, the touchsurface is conductive in part or in whole, or a conductive element is attached to the touchsurface, and held at a constant voltage such as system ground. A change in location of the touchsurface alters the electric field near the sensor electrodes below the touchsurface, thus changing the measured capacitive coupling. In one implementation, an absolute capacitance sensing method operates with a capacitive sensor electrode underlying a component having the touchsurface, modulates that sensor electrodes with respect to a reference voltage (e.g., system ground), and detects the capacitive coupling between that sensor electrode and the component having the touchsurface for gauging the press state of the touchsurface.

Some capacitive implementations utilize "mutual capacitance" (or "transcapacitance") sensing methods based on changes in the capacitive coupling between sensor electrodes. In various embodiments, the proximity of a touchsurface near the sensor electrodes alters the electric field between the sensor electrodes, thus changing the measured capacitive coupling. The touchsurface may be a conductive or non-conductive, electrically driven or floating, as long as its motion causes measurable change in the capacitive coupling between sensor electrodes. In some implementations, a transcapacitive sensing method operates by detecting the capacitive coupling between one or more transmitter sensor electrodes (also "transmitters") and one or more receiver sensor electrodes (also "receivers"). Transmitter sensor electrodes may be modulated relative to a reference voltage (e.g., system ground) to transmit transmitter signals. Receiver sensor electrodes may be held substantially constant relative to the reference voltage to facilitate receipt of resulting signals. A resulting signal may comprise effect(s) corresponding to one or more transmitter signals, and/or to one or more sources of environmental interference (e.g., other electromagnetic signals). Sensor electrodes may be dedicated transmitters or receivers, or may be configured to both transmit and receive.

In one implementation, a trans-capacitance sensing method operates with two capacitive sensor electrodes underlying a touchsurface, one transmitter and one receiver. The resulting signal received by the receiver is affected by the transmitter signal and the location of the touchsurface.

In some embodiments, the sensor system used to detect touchsurface presses may also detect pre-presses. For example, a capacitive sensor system may also be able to detect a user lightly touching a touchsurface, and distinguish that from the press of the touchsurface. Such a system can support multi-stage touchsurface input, which can respond differently to light touch and press.

Some embodiments are configured to gauge the amount of force being applied on the touchsurface from the effect that the force has on the sensor signals. That is, the amount of depression of the touchsurface is correlated with one or more particular sensor readings, such that the amount of press force can be determined from the sensor reading(s).

In some embodiments, substrates used for sensing are also used to provide backlighting associated with the touchsurfaces. As a specific example, in some embodiments utilizing capacitive sensors underlying the touchsurface, the capacitive sensor electrodes are disposed on a transparent or translucent circuit substrate such as polyethylene terephthalate (PET), another polymer, or glass. Some of those embodiments use the circuit substrate as part of a light guide system for backlighting symbols viewable through the touchsurfaces.

FIG. 1 also shows a section line A-A' relative to the key 122 of the keyboard 100, which will be discussed below.

The keyboard 100 may be integrated into or coupled to a computer such as a laptop computer comprising one or more processing systems formed from one or more ICs (integrated circuits) having appropriate processor-executable instructions for responding to key presses. These instructions direct the appropriate IC(s) to operate keyboard sensors to determine if a key has been pressed (or the extent of the press), and provide an indication of press status to a main CPU of the laptop or a response to the press status to a user of the laptop.

While the orientation terminology, vertical-lateral travel, sensing technology, and implementation options discussed here focuses on the keyboard 100, these discussions are readily analogized to other touchsurfaces and devices described herein.

Figure 2:
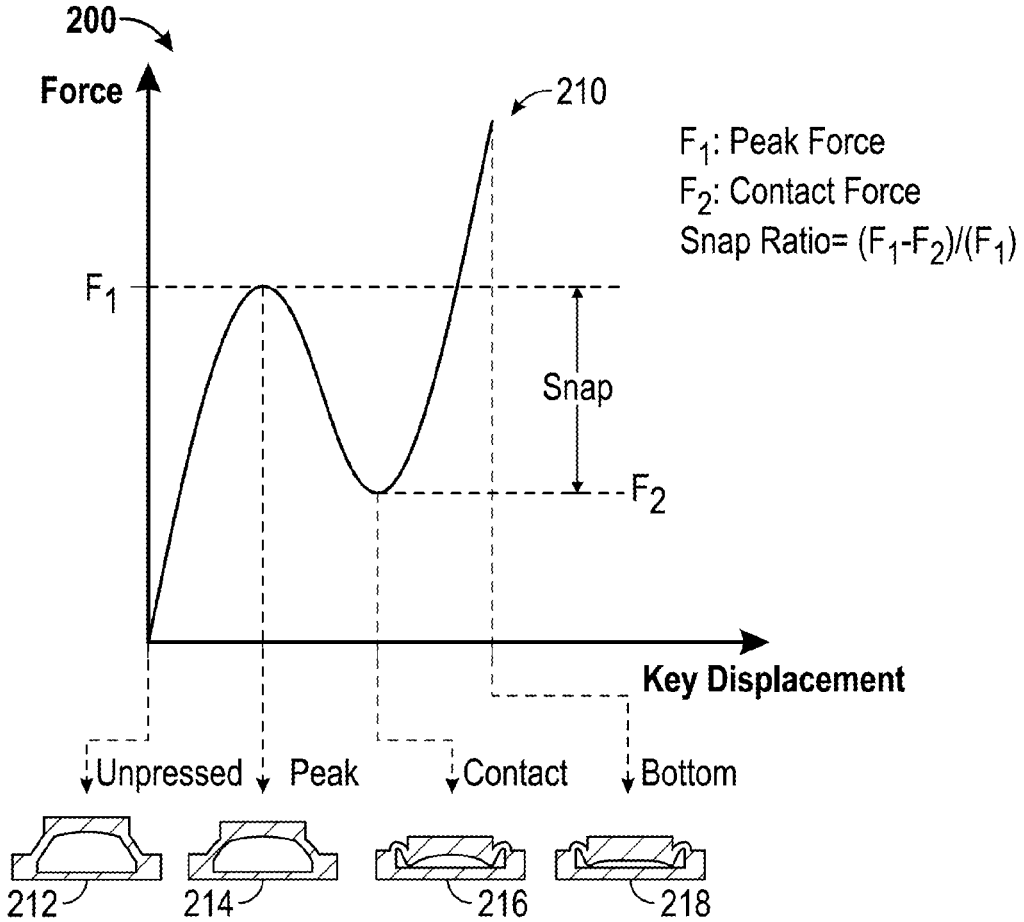
FIG. 2 is a graph of an example tactile response that is characteristic of many keys enabled with metal snap domes or rubber domes.

Various embodiments in accordance with the techniques described herein, including embodiments without metal snap domes or rubber domes, provide force response curves similar to the curve 210 of FIG. 2. Many tactile keyboard keys utilize snap ratios no less than 0.4 and no more than 0.6. Other tactile keyboard keys may use snap ratios outside of these ranges, such as no less than 0.3 and no more than 0.5, and no less than 0.5 and no more than 0.7.

Other embodiments provide other response curves having other shapes, including those with force and key travel relationships that are linear or nonlinear. Example nonlinear relationships include those which are piecewise linear, which contain linear and nonlinear sections, or which have constantly varying slopes. The force response curves may also be non-monotonic, monotonic, or strictly monotonic For example, the keys 120 made in accordance with the techniques described herein may be configured to provide the response shown by curve 210, or any appropriate response curve. The reaction force applied to a user may increase linearly or nonlinearly relative to an amount of total key travel, an amount of key travel the press direction, or an amount of key travel in a lateral direction. As a specific example, the force applied may increase with a constant slope relative to the amount of key travel for up to a first amount of force or key movement relative to its unpressed position, and then plateau (with constant force) or decrease for up to a second amount of force or key movement.

Figure 3A:
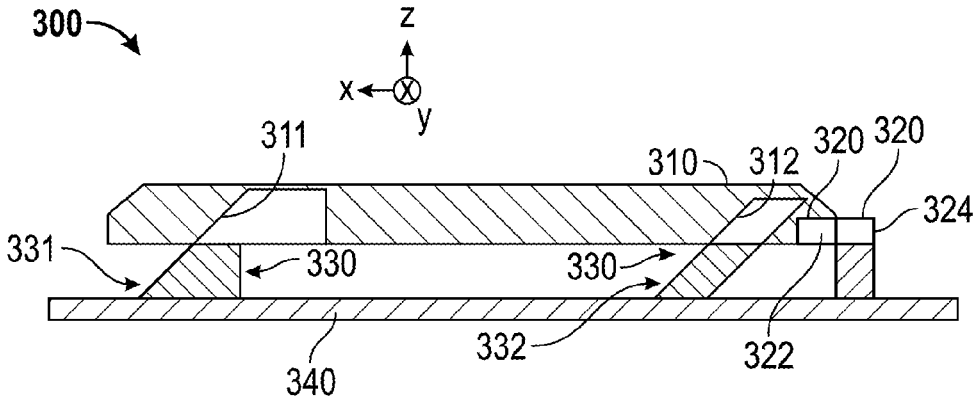
FIGS. 3A-3B are simplified side views of a first example touchsurface assembly configured in accordance with the techniques described herein.
Figure 3B:
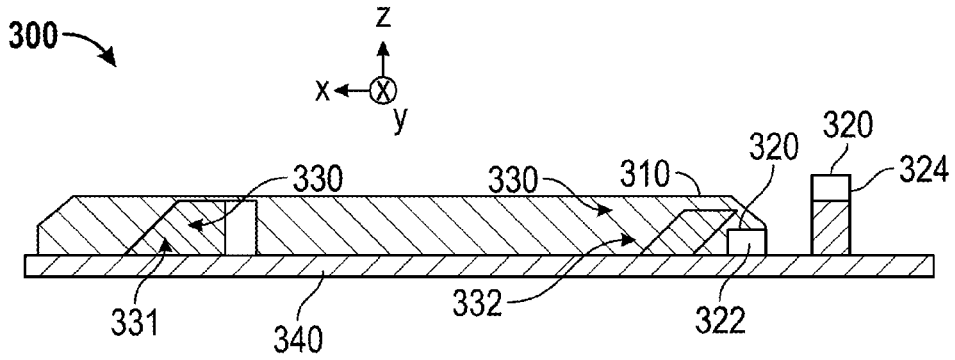

FIGS. 3A-3B are simplified cross-sectional views of a first example touchsurface assembly. The key assembly 300 may be used to implement various keys, including the key 122 of the keyboard 100. In the embodiment where FIGS. 3A-B depict the key 122, these figures illustrate A-A' sectional views of the key 122. FIG. 3A shows the example key assembly 300 in an unpressed position and FIG. 3B shows the same key assembly 300 in a pressed position. The key assembly 300 may also be used in other devices utilizing keys, including keyboards other than the keyboard 100 and any other appropriate key-using device. Further, assemblies analogous to the key assembly 300 may be used to enable non-key touchsurface assemblies such as buttons, opaque touchpads, touchscreens, or any of the touchsurface assemblies described herein.

The key assembly 300 includes a keycap 310 that is visible to users and configured to be pressed by users, a ready/return mechanism 320, and a base 340. The unpressed and pressed positions of the keycap 310 are spaced in a press direction and in a first lateral direction orthogonal to the press direction. The press direction is analogous to the key motion found in conventional keyboards lacking lateral key motion, is in the negative-Z direction, and is the primary direction of press and key motion. In many keyboards the press direction is orthogonal to the touchsurface of the keycap or the base of the key, such that users would consider the press direction to be downwards toward the base.

The components of the key assembly 300 may be made from any appropriate material, including plastics such as polycarbonate (PC), acrylonitrile butadiene styrene (ABS), nylon, and acetal, metals such as steel and aluminum, elastomers such as rubber, and various other materials. In various embodiments, the keycap 310 is configured to be substantially rigid, such that the touchsurface of the keycap 310 appears to unaided human senses to move with rigid body motion between its unpressed and pressed positions during normal operation.

The ready/return mechanism 320 is a type of "biasing mechanism" that provides both readying and returning functions. The ready/return mechanism 320 physically biases the keycap 310 during at least part of the key press operation. It should be noted that a mechanism which only provides readying or returning function may also be termed "biasing mechanism," if it biases the keycap 310 during at least part of the key press operation. The ready/return mechanism 320 is configured to hold the keycap 310 in its unpressed position so that the keycap 310 is ready to be pressed by a user. In addition, the ready/return mechanism 320 is also configured to return the keycap 310 partially or entirely to the unpressed position in response to a release of the press force to keycap 310. The release of the press force may be a removal of the press force, or a sufficient reduction of press force such that the key assembly is able to return the keycap 310 to the unpressed position as a matter of normal operation. In the example embodiment of FIG. 3, the key assembly 300 utilizes magnetically coupled components 322, 324 to form the ready/return mechanism 320. Magnetically coupled components 322, 324 may both comprise magnets, or one may comprise a magnet while the other comprise a magnetically coupled material such as a ferrous material. Although magnetically coupled components 322, 324 are each shown as a single rectangular shape, either or both magnetically coupled components 322, 324 may comprise non-rectangular cross section(s) or comprise a plurality of magnetically coupled subcomponents having the same or different cross sections. For example, magnetically coupled component 322 or 324 may comprise a magnetic, box-shaped subcomponent disposed against a central portion of a ferrous, U-shaped subcomponent.

In some implementations, the magnetically coupled component 322 is physically attached to a bezel or base proximate to the keycap 310. The magnetically coupled component 324 is physically attached to the keycap and magnetically interacts with the magnetically coupled component 322. The physical attachment of the magnetically coupled components 322, 324 may be direct or indirect (via one or more intermediate components), and may be accomplished by press fits, adhesives, or any other technique or combination of techniques. The amount of press force needed on the keycap to overcome the magnetic coupling (e.g., overpower the magnetic attraction or repulsion) can be customized based upon the size, type, shape, and positions of the magnetically coupling components 322, 324 involved.

The key assembly 300 comprises a planar-translation-effecting (PTE) mechanism 330 configured to impart planar translation to the keycap 310 when it moves between the unpressed and pressed positions, such that a nonzero component of lateral motion occurs. The PTE mechanism 330 is formed from parts of the keycap 310 and the base 340, and comprises four ramps (two ramps 331, 332 are visible in FIGS. 3A-B) disposed on the base 340. These four ramps are located such that they are proximate to the corners of the keycap 310 when the key assembly 300 is assembled. In the embodiment shown in FIGS. 3A-B, these four ramps (including ramps 331, 332) are simple, sloped planar ramps located at an angle to the base 340. These four ramps (including ramps 331, 332) are configured to physically contact corresponding ramp contacting features (two ramp contacting features 311, 312 are visible in FIGS. 3A-B) disposed on the underside of the keycap 310. The ramp contacting features of the keycap 310 may be any appropriate shape, including ramps matched to those of the ramps on the base 340.

In response to a press force applied to the touchsurface of the keycap 310 downwards along the press direction, the ramps on the base 340 (including ramps 331, 332) provide reaction forces. These reaction forces are normal to the ramps and include lateral components that cause the keycap 310 to exhibit lateral motion. The ramps and some retention or alignment features that mate with other features in the bezel or other appropriate component (not shown) help retain and level the keycap 310. That is, they keep the keycap 310 from separating from the ramps and in substantially the same orientation when travelling from the unpressed to the pressed position.

As shown by FIGS. 3A-B, the keycap 310 is urged to move in the press direction (negative Z-direction) in response to a press force applied to the top of the keycap 310. As a result, the keycap 310 moves in a lateral direction (in the positive X-direction) and in the press direction (in the negative Z-direction) due to the reaction forces associated with the ramps. The ramp contacting features (e.g., 311, 312) of the keycap 310 ride on the ramps of the base 340 (e.g., 331, 332) as the keycap 310 moves from the unpressed to the pressed position. This motion of the keycap 310 moves the magnetically coupled components 322, 324 relative to each other, and changes their magnetic interactions.

FIG. 3B shows the keycap 310 in the pressed position. For the key assembly 300, the keycap 310 has moved to the pressed position when it directly or indirectly contacts the base 340 or has moved far enough to be sensed as a key press. FIG. 3A-B do not illustrate the sensor(s) used to detect the press state of the keycap 310, and such sensor(s) may be based on any appropriate technology, as discussed above.

When the press force is released, the ready/return mechanism 320 returns the keycap 310 to its unpressed position. The attractive forces between the magnetically coupled components 322, 324 pull the keycap 310 back up the ramps (including the ramps 331, 322), toward the unpressed position.

Many embodiments using magnetic forces utilize permanent magnets. Example permanent magnets include, in order of strongest magnetic strength to the weakest: neodymium iron boron, samarium cobalt, alnico, and ceramic. Neodymium-based magnets are rare earth magnets, and are very strong magnets made from alloys of rare earth elements. Alternative implementations include other rare earth magnets, non-rare earth permanent magnets, and electromagnets.

Although the key assembly 300 utilizes magnetically coupled components to form its ready/return mechanism 320, various other techniques can be used instead or in addition to such magnetic techniques in other embodiments. In addition, separate mechanisms may be used to accomplish the readying and returning functions separately. For example, one or more mechanisms may retain the keycap in its ready position and one or more other mechanisms may return the keycap to its ready position. Examples of other readying, returning, or ready/return mechanisms include buckling elastomeric structures, snapping metallic domes, deflecting plastic or metal springs, stretching elastic bands, bending cantilever beams, and the like. In addition, in some embodiments, the ready/return mechanism push (instead of pull) the keycap 310 to resist keycap motion to the pressed position or to return it to the unpressed position. Such embodiments may use magnetic repulsion or any other appropriate technique imparting push forces.

Many variations of or additions to the components of the key assembly 300 are possible. For example, other embodiments may include fewer or more components. As a specific example, another key assembly may incorporate any number of additional aesthetic or functional components. Some embodiments include bezels that provide functions such as hiding some of the key assembly from view, protecting the other components of the key assembly, helping to retain or guide the touchsurface of the key assembly, or some other function.

As another example, other embodiments may comprise different keycaps, readying mechanisms, returning mechanisms, PTE mechanisms, leveling mechanisms, or bases. As a specific example, the keycap 310, the base 340, or another component that is not shown may comprise protrusions, depressions, or other features that help guide or retain the keycap 310. As another specific example, some embodiments use non-ramp techniques in place or (or in addition to) ramps to effect planar translation. Examples other PTE mechanisms include various linkage systems, cams, pegs and slots, bearing surfaces, and other motion alignment features.

As yet another example, although the PTE mechanism 330 is shown in FIGS. 3A-B as having ramps disposed on the base 340 and ramp contacting features disposed on the keycap 310, other embodiments may have one or more ramps disposed on the keycap 310 and ramp contacting features disposed on the base 340. Also, the PTE mechanism 330 is shown in FIGS. 3A-B as having ramps 331, 332 with simple, sloped plane ramp profiles. However, in various embodiments, the PTE mechanism 330 may utilize other profiles, including those with linear, piecewise linear, or nonlinear sections, those having simple or complex curves or surfaces, or those including various convex and concave features. Similarly, the ramp contacting features on the keycap 310 may be simple or complex, and may comprise linear, piecewise linear, or nonlinear sections. As some specific examples, the ramp contacting features may comprise simple ramps, parts of spheres, sections of cylinders, and the like. Further, the ramp contacting features on the keycap 310 may make point, line, or surface contact the ramps on the base 340 (including ramps 331, 332). "Ramp profile" is used herein to indicate the contour of the surfaces of any ramps used for the PTE mechanisms. In some embodiments, a single keyboard may employ a plurality of different ramp profiles in order to provide different tactile responses for different keys.

As a further example, embodiments which level their touchsurfaces may use various leveling techniques which use none, part, or all of the associate PTE mechanism.

Figure 4:
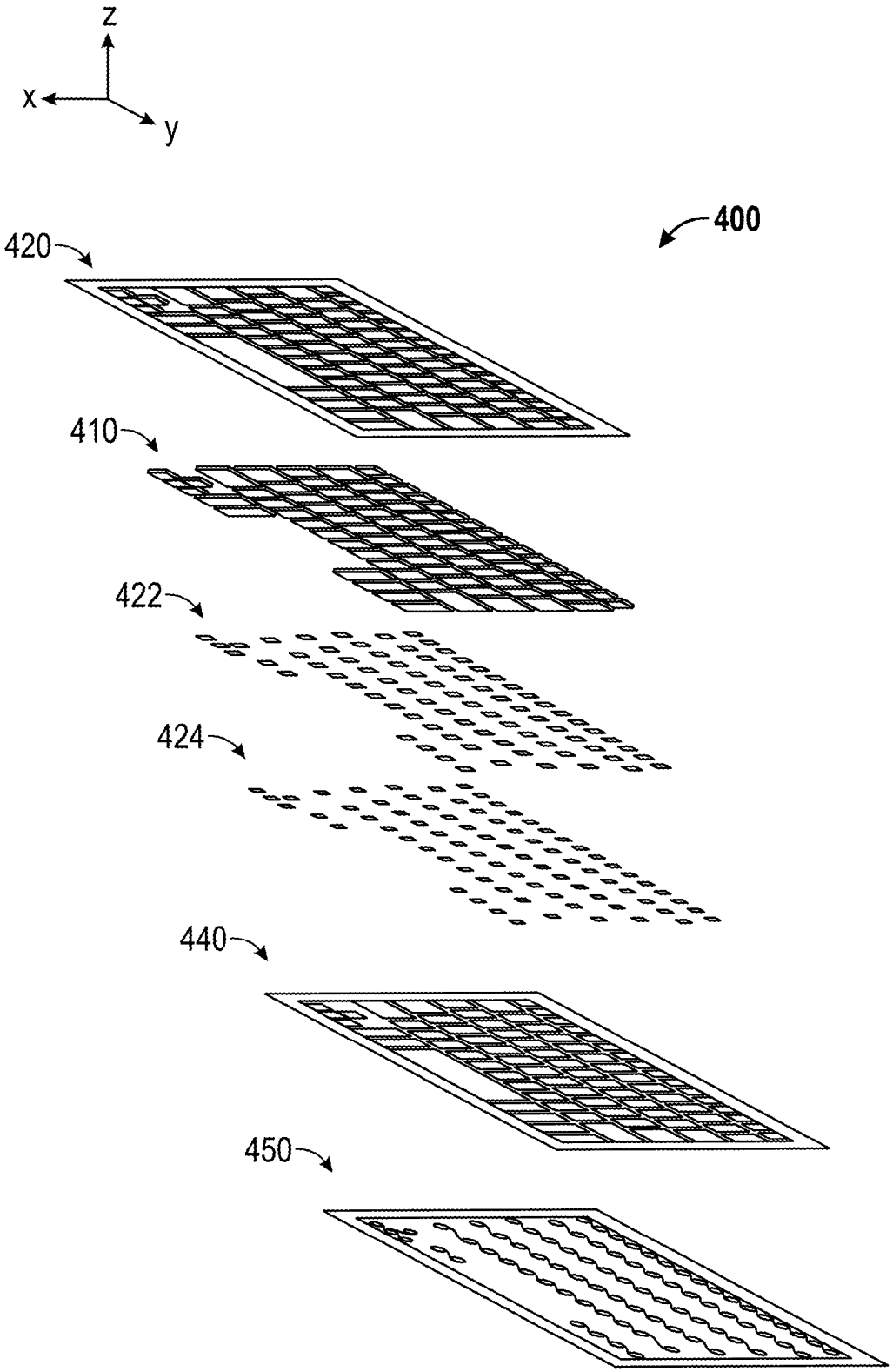
FIG. 4 shows an exploded view of an example keyboard in accordance with the techniques described herein

FIG. 4 shows an exploded view of an example keyboard construction 400 in accordance with the techniques described herein. A construction like the keyboard construction 400 may be used to implement any number of different keyboards, including keyboard 100. Proceeding from the top to the bottom of the keyboard, the bezel 420 comprises a plurality of apertures through which keycaps 410 of various sizes are accessible in the final assembly. Magnetically coupled components 422, 424 are attached to the keycaps 410 or the base 440, respectively. The base 440 comprises a plurality of PTE mechanisms (illustrated as simple rectangles on the base 440) configured to guide the motion of the keycaps 410. Underneath the base 440 is a key sensor 450, which comprises one or more layers of circuitry disposed on one or more substrates.

Various details have been simplified for ease of understanding. For example, adhesives that may be used to bond components together are not shown. Also, various embodiments may have more or fewer components than shown in keyboard construction 400, or the components may be in a different order. For example, the base and the key sensor 450 may be combined into one component, or swapped in the stack-up order.

Although the discussion below are in connection with keys and key assemblies, similar approaches and techniques can enable non-key touchsurface assemblies.

Figure 5A:
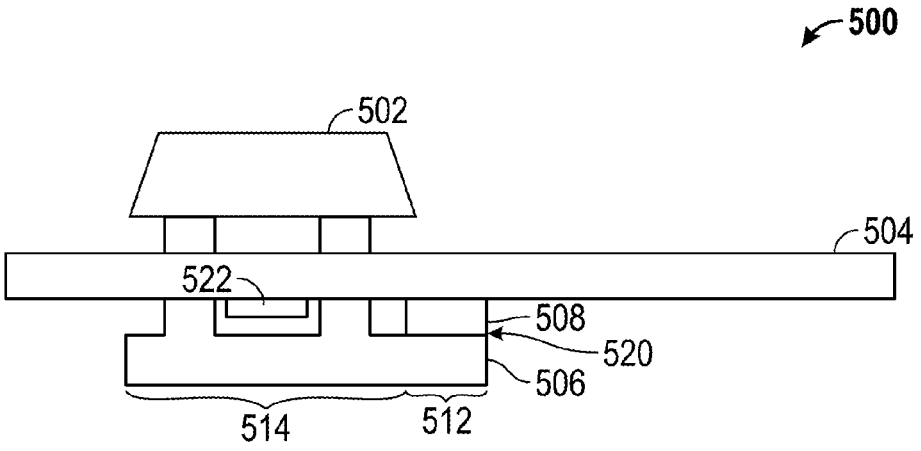
FIGS. 5A-B show simplified side views of an example key assembly according to an embodiment.
Figure 5B:
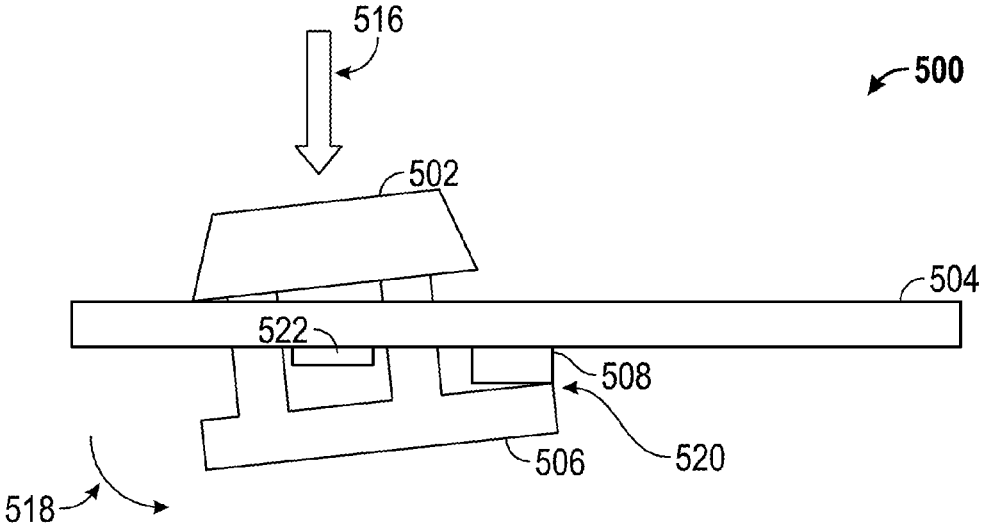

FIGS. 5A-B show simplified side views of an example key assembly. Specifically, FIGS. 5A-B show a key assembly 500 that may be used to enable the key 122 of the keyboard 100. The key assembly 500 may also be used in other devices utilizing keys, including keyboards other than the keyboard 100 and any other appropriate key-using device. Further, assemblies analogous to the key assembly 500 may be used to enable non-key touchsurface assemblies with pressable touchsurfaces, such as buttons, opaque touchpads, touchscreens, or any of the touchsystems described herein.

The key assembly 500 comprises a keycap 502 that is visible to users and configured to be pressed by users in a press direction toward a base 504. FIG. 5A illustrates a side view of the key assembly 500 in an unpressed position, where the keycap 502 is held (or supported) in a ready position by a keycap coupler 506. In the embodiment illustrated in FIG. 5A, the keycap coupler 506 is physically coupled to the keycap 502 and has a first portion 512 magnetically attracted to a magnet 508 that is mounted to the base 504. The keycap coupler also has a second portion 514 that is cantilevered from the magnet 508 and couples to the keycap 502. The keycap coupler 506 and the keycap 502 may be coupled by any appropriate method, including coupled directly or indirectly through one or more intermediate components, attached by application of liquid or film adhesive, heat staking, clamping, or co-molding, and the like.

In the exemplary embodiment of FIGS. 5A-B, the keycap coupler 506 and the magnet 508 are positioned on the same side of the base 504 (beneath the base in this example) to form a magnetic hinge and provides the functions of a ready/return mechanism for the key assembly 500. In some embodiments, at least the first portion 512 of the keycap coupler 506 is a magnet of opposite polarity than the magnet 508, or includes a magnet as a portion of the keycap coupler 506. In some embodiments, at least the first portion 512 of the keycap coupler 506 or includes a non-magnetized ferrous material that is magnetically attracted to the magnet 508. In some embodiments, the second portion 514 of the keycap coupler 506 is also a magnet or ferrous material or includes either or both. In some embodiments the second portion 514 of the keycap coupler 506 is made of a non-magnetic material, which may reduce weight and/or cost of keycap assembly 500.

In FIG. 5B, a press force 516 is applied to the keycap 502 sufficient to overcome the magnetic attraction between the keycap coupler 506 and the magnet 508. When this occurs, the keycap coupler pivots away from the magnet 508 (along direction 518) about a pivot axis 520 located on the magnet 508 (or an edge thereof), resulting in the keycap 502 traveling toward the base 504. The magnetic attraction between the keycap coupler 506 and the magnet 508 provide a magnetic bias force that resists the press force 516. When the press force 516 is reduced below the magnetic bias force or removed, the magnetic attraction between the keycap coupler 506 and the magnet 508 returns the keycap to the unpressed (ready) position as illustrated in FIG. 5A. In some embodiments, the size or shape of the keycap coupler 506 or magnet 508 may be used to adjust or tune the break-over response, including the amount of required press force to operate the key assembly 500. As a non-limiting example, an edge of the keycap coupler 506 or magnet 508 may be beveled or chaffered at various angles at or near the pivot axis 520.

In some embodiments, the key assembly 500 also comprises a sensor 522 for detecting the pressed state of the keycap 502. The sensor may use any appropriate technology, including any of the ones described herein. In some embodiments, the sensor 522 detects changes in capacitance, the keycap 502 comprises primarily dielectric material, and the change in the position of the dielectric material of the keycap 502 causes changes in capacitance detected by the sensor 522. In some embodiments, the sensor 522 detect changes in capacitance, conductive material is disposed in or on the keycap 502, and the change in position of the conductive material of the keycap 522 causes changes in capacitance detected by the sensor 522. In some embodiments, the sensor is configured to sense a change in position of the keycap coupler 506. In some embodiments, the sensor 522 is configured to actively detect unpressed and pressed positions of the keycap 502. In some embodiments, the sensor 522 is configured to actively detect only the pressed state of the keycap 502, and it is assumed that no detection of the pressed state means the keycap 502 is unpressed, or vice versa. A processing system (not shown) communicatively coupled to the sensor 522 operates the sensor 522 to produce signals indicative of the press state of the key assembly 500, and determines a press state of the keycap 502 based on these signals.

Many variations of the magnetic hinge feature are contemplated and several exemplary embodiments are illustrated below. Although most of the embodiments discussed are presented in association with key assemblies and keyboards, they are readily applied to non-key-based touchsurface assemblies.

Figure 6A:
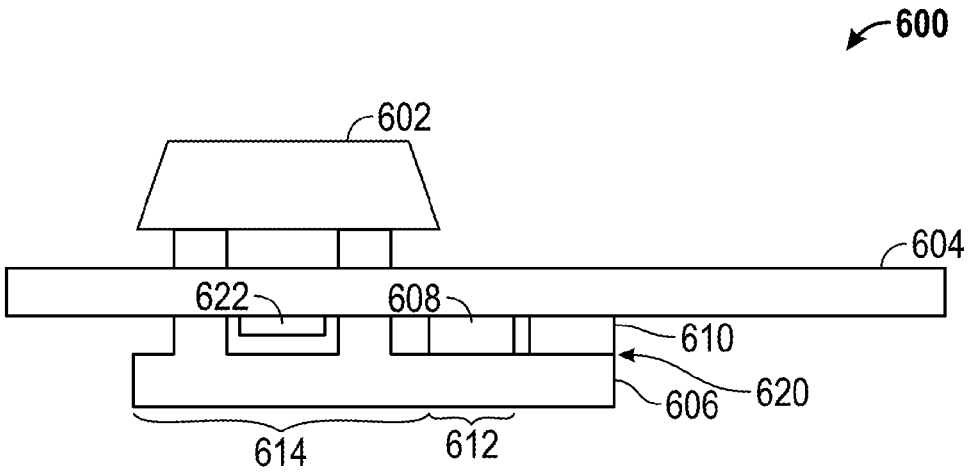
FIGS. 6A-B show simplified side views of an example key assembly according to an embodiment.
Figure 6B:
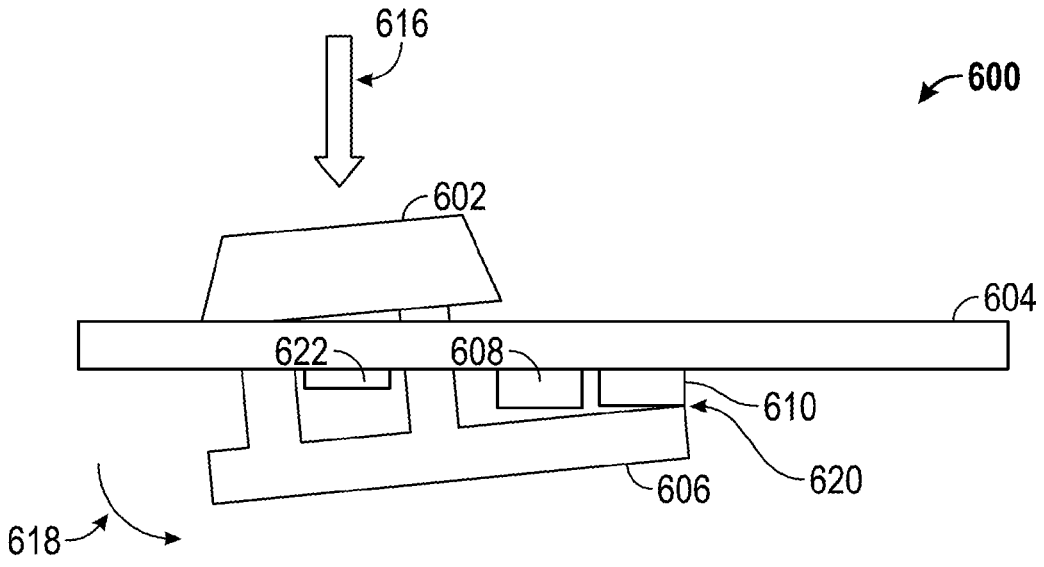

FIGS. 6A-B show simplified side views of an example key assembly 600 that may be used to enable the key 122 of the keyboard 100 or some other pressable touchsurface assembly. The key assembly 600 comprises a keycap 602 that is visible to users and configured to be pressed by users in a press direction toward a base 604. FIG. 6A illustrates a side view of the key assembly 600 in an unpressed position, where the keycap 602 is held (or supported) in a ready position by a keycap coupler 606. In the embodiment illustrated in FIG. 6A, the keycap coupler 606 is physically coupled to the keycap 602 and has a first portion 612 magnetically attracted to a magnet 608 that is mounted to the base 604. The keycap coupler also has a second portion 614 that is cantilevered from the magnet 608 and couples to the keycap 602. The embodiment of FIGS. 6A-B has a keycap coupler that extends over a component 610. As will be discussed in more detail below, the component 610 locates the pivot axis of the magnet hinge further away from the keycap 602, such that the magnet 608 is located between the keycap 602 and the component 610. Additionally, the location, size, or shape of the component 610 may be used to adjust or tune the break-over response, including the amount of required press force to operate the key assembly 600. Thus, certain designs of the key assembly 600 may provide a more appealing tactile response to a user.

In the exemplary embodiment of FIGS. 6A-B, the keycap coupler 610 and the magnet 608 are positioned on the same side of the base 504 (beneath the base in this example) to form parts of a magnetic hinge and provide the functions of a ready/return mechanism for the key assembly 600. In some embodiments, at least the first portion of the keycap coupler is a magnet of opposite polarity than the magnet 608. In some embodiments, at least the first portion 612 of the keycap coupler is includes a non-magnetized ferrous material that is magnetically attracted to the magnet 608. In some embodiments, the second portion 614 of the keycap coupler 606 is also a magnet or ferrous material. In some embodiments, the second portion 614 of the keycap coupler 606 is made of a non-magnetic material.

In FIG. 6B, a press force 616 is applied to the keycap 602 sufficient to overcome the magnetic attraction between the keycap coupler 606 and the magnet 608. When this occurs, the keycap coupler 606 pivots away from the magnet 608 (along direction 618) about a pivot axis 620 resulting in the keycap traveling toward the base 604. In the embodiment illustrated in FIG. 6B, the magnet 608 is positioned between the keycap 602 (or an edge thereof) and the pivot axis 620. The magnetic attraction between the keycap coupler 606 and the magnet 608 provide a magnetic bias force that resists the press force 616, and when the press force 616 is reduced below the magnetic bias force or removed, the magnetic attraction between the keycap coupler 606 and the magnet 608 return the keycap to the unpressed (ready) position as illustrated in FIG. 6A. The component 610 may be a non-magnetic component and helps to position the pivot axis 620 as desired for any particular implementation. In such an embodiment, the keycap coupler 606 physically separates from the magnet 608 when the keycap 602 is in the pressed position. In some embodiments, the component 610 may be a magnet having a magnetic field strength the same or different from that of the magnet 608, and adjusts the magnetic forces provided by the ready/return mechanism of the key assembly 600.

In some embodiments, the key assembly 600 also comprises a sensor 622 for detecting the pressed state of the keycap 602. The sensor 622 may be configured and operate in a similar manner as that described above in connection with FIGS. 5A-B.

Figure 7A:
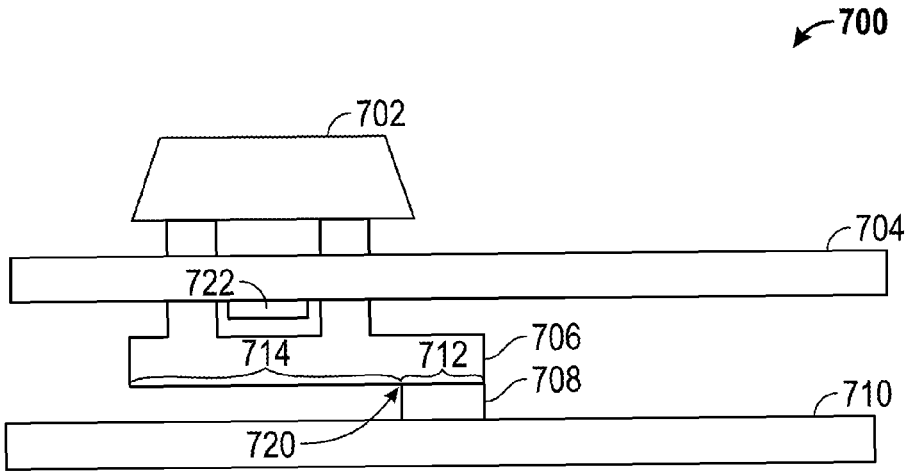
FIGS. 7A-B show simplified side views of an example key assembly according to an embodiment.
Figure 7B:
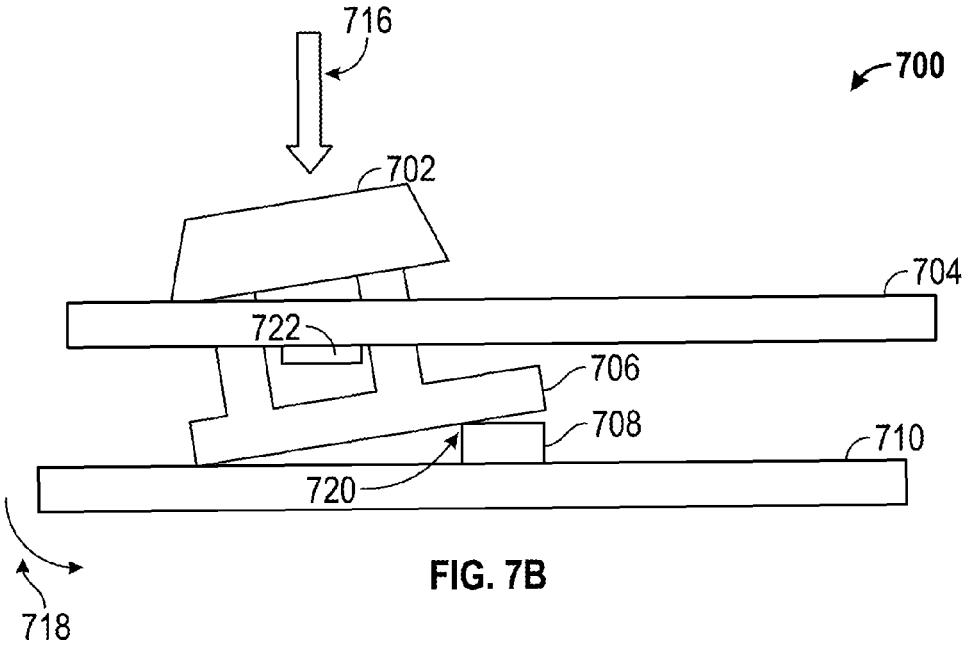

FIGS. 7A-B show simplified side views of an example key assembly 700 that may be used to enable the key 122 of the keyboard 100 or some other pressable touchsurface assembly. The key assembly 700 comprises a keycap 702 that is visible to users and configured to be pressed by users in a press direction toward a base 704. FIG. 7A illustrates a side view of the key assembly 700 in an unpressed position, where the keycap 702 is held (or supported) in a ready position above a base (or bezel) 704 by a keycap coupler 706. In the embodiment illustrated in FIG. 7A, the keycap coupler 706 is physically coupled to the keycap 702 and has a first portion 712 magnetically attracted to a magnet 708 that is mounted to a chassis 710. The keycap coupler also has a second portion 714 that is cantilevered from the magnet 708 and couples to the keycap 702. As compared to the embodiment of FIGS. 5A-B, the embodiment of FIGS. 7A-B has the keycap coupler 706 positioned above the magnet 708 as opposed to being positioned below the magnet 508 as shown in FIGS. 5A-B.

In the exemplary embodiment of FIGS. 7A-B, the keycap coupler 706 and the magnet 708 form a magnetic hinge and provide the functions of a ready/return mechanism for the key assembly 700. In some embodiments, at least the first portion 712 of the keycap coupler 706 is a magnet of opposite polarity than the magnet 708. In some embodiments, at least the first portion 712 of the keycap coupler 706 includes a non-magnetized ferrous material that is magnetically attracted to the magnet 708. In some embodiments, the second portion 714 of the keycap coupler 706 is also a magnet or ferrous material. In some embodiments the second portion 714 of the keycap coupler 706 is made of a non-magnetic material. In some embodiments, the size or shape of the keycap coupler 706 or magnet 708 may be used to adjust or tune the break-over response, including the amount of required press force to operate the key assembly 700. As a non-limiting example, an edge of the keycap coupler 706 or magnet 708 may be beveled or chaffered at various angles at or near the pivot axis 720.

In FIG. 7B, a press force 716 is applied to the keycap 702 sufficient to overcome the magnetic attraction between the keycap coupler 706 and the magnet 708. When this occurs, the keycap coupler pivots away from the magnet (along direction 718) about a pivot axis 720 illustrated as being on the magnet 708 (or an edge thereof), resulting in the keycap traveling toward the base 704. The magnetic attraction between the keycap coupler 706 and the magnet 708 provide a magnetic bias force that resists the press force 716. When the press force 716 is reduced below the magnetic bias force or removed, the magnetic attraction between the keycap coupler 706 and the magnet 708 return the keycap to the unpressed (ready) position as illustrated in FIG. 7A.

In some embodiments, the key assembly 700 also comprises a sensor 722 for detecting the pressed state of the keycap 702. The sensor 722 may be configured and operate in a similar manner as that described above in connection with FIGS. 5A-B. Also, in some embodiments, the sensor 722 may also be positioned on the chassis 710 and sense the position of the keycap coupler 706.

Figure 8A:
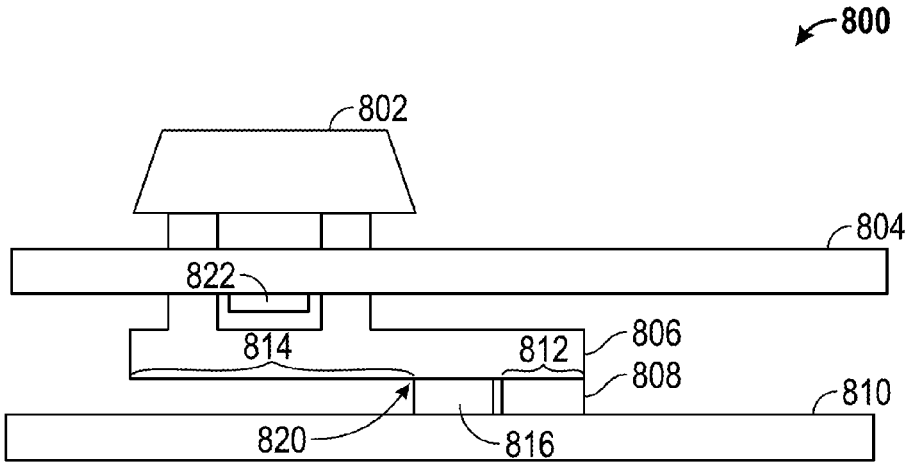
FIG. 8 A-B show simplified side views of an example key assembly according to an embodiment.
Figure 8B:
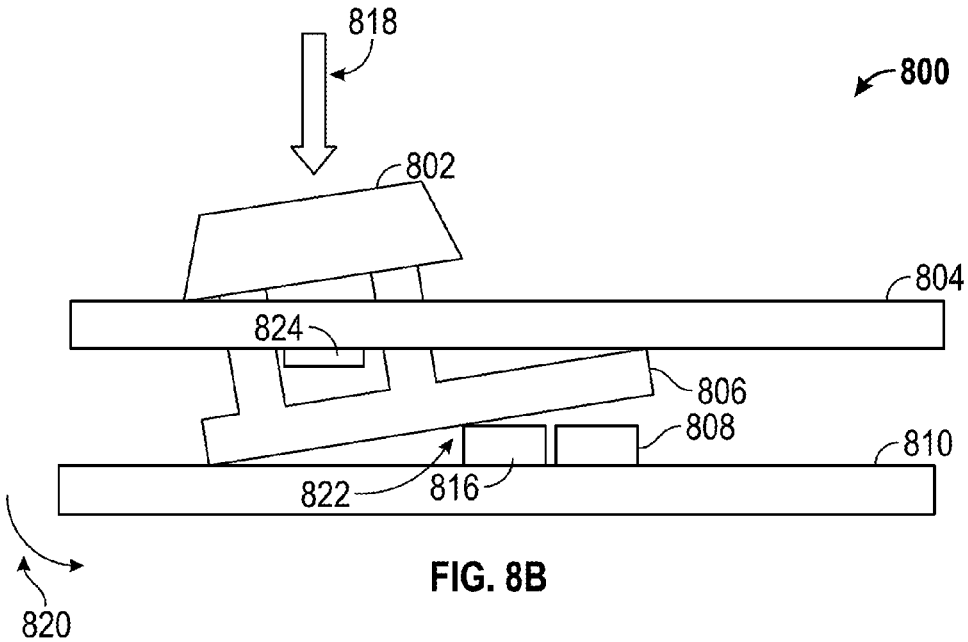

FIGS. 8A-B show simplified side views of an example key assembly 800 that may be used to enable the key 122 of the keyboard 100 or some other pressable touchsurface assembly. The key assembly 800 comprises a keycap 802 that is visible to users and configured to be pressed by users in a press direction toward a base 804. FIG. 8A illustrates a side view of the key assembly 800 in an unpressed position, where the keycap 802 is held (or supported) in a ready position above a base (or bezel) 804 by a keycap coupler 806. In the embodiment illustrated in FIG. 8A, the keycap coupler 806 is physically coupled to the keycap 802 and has a first portion 812 magnetically attracted to a magnet 808 that is mounted to a chassis 810. The keycap coupler also has a second portion 814 that is cantilevered from the magnet 808 and couples to the keycap 802. The embodiment of FIGS. 8A-B has a keycap coupler that extends over a component 816 positioned between the magnet 808 and the keycap 802. As will be discussed in more detail below, the component 816 positions the pivot axis of the magnetic hinge between the keycap 802 and the magnet 808, and helps to define the tactile response to a user when the keycap 802 is pressed. Additionally, the location, size, or shape of the component 816 may be used to adjust or tune the break-over response or the amount of required press force to operate the key assembly 800. Thus, certain designs of the key assembly 800 may provide a more appealing tactile response to a user.

In the exemplary embodiment of FIGS. 8A-B, the keycap coupler and the magnet form are positioned on the same side of the base 504 (beneath the base in this example) to a magnetic hinge and provide the functions of a ready/return mechanism for the key assembly 800. In some embodiments, at least the first portion of the keycap coupler is (or includes) a magnet of opposite polarity than the magnet 808. In some embodiments, at least the first portion 812 of the keycap coupler is (or includes) a ferrous material that is magnetically attracted to the magnet 808. In some embodiments, the second portion 814 of the keycap coupler 806 is also (or includes) a magnet or ferrous material. In some embodiments the second portion 814 of the keycap coupler 806 is made of a non-magnetized material.

In FIG. 8B, a press force 818 is applied to the keycap 802 sufficient to overcome the magnetic attraction between the keycap coupler 806 and the magnet 808. When this occurs, the keycap coupler pivots away from the magnet (along direction 818) about a pivot axis 820 resulting in the keycap traveling toward the base 804. In the embodiment illustrated in FIG. 8B, the component 816 is positioned between the keycap 802 and the magnet 808 and helps to locate the pivot axis 820 between the keycap 802 and the magnet 808. The magnetic attraction between the keycap coupler 806 and the magnet 808 provide a magnetic bias force that resists the press force 816. When the press force 816 is reduced below the magnetic bias force or removed, the magnetic attraction between the keycap coupler 806 and the magnet 808 return the keycap to the unpressed (ready) position as illustrated in FIG. 8A. The component 816 may be a non-magnetic component. In such an embodiment, the keycap coupler 806 separates from the magnet 808 due to the pivot point 822 being between the magnet 808 the keycap 802 (or an edge thereof). In some embodiments, the component 816 may be a magnet that changes the magnetic forces provided by the ready/return mechanism of the key assembly 800.

In some embodiments, the key assembly 800 also comprises a sensor 822 for detecting the pressed state of the keycap 802. The sensor 822 may be configured and operate in a similar manner as that described above in connection with FIGS. 5A-B. Also, in some embodiments, the sensor 822 may also be positioned on the chassis 810 and sense the position of the keycap coupler 806.

It will be appreciated that each of the key assemblies of FIGS. 5-8 have been illustrated in simple block cross-section form to facilitate understanding. More complex cross-section forms are contemplated, including, without limitation, having the magnet (e.g., 508) incorporated in whole or in part into the base (e.g., 504). In some embodiments, the magnet (e.g., 608) could be incorporated in whole or in part into the component (e.g., 610) or partially in the component and partially in the base. Still other embodiments contemplate the addition of a protective layer or film disposed between the magnet (e.g., 508) and the keycap coupler (e.g., 506) to reduce wear on the magnet surface due to repeated uncoupling and recoupling to the keycap coupler.

Figure 9:
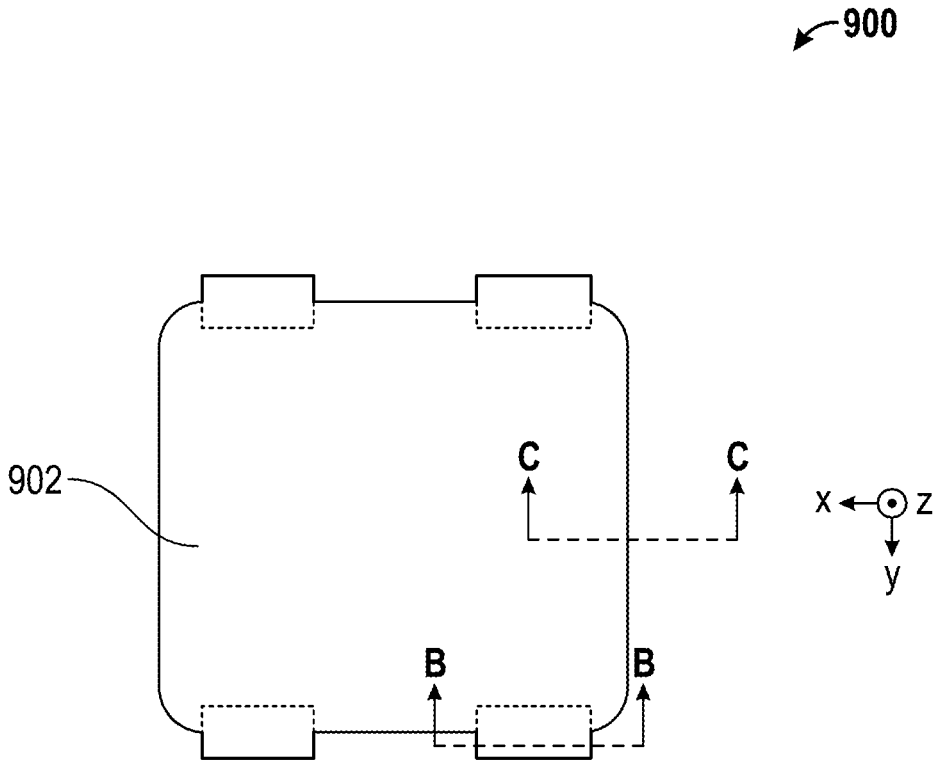
FIG. 9 shows a top plan view of an example key according to an embodiment.

FIG. 9 shows a top plan view of an example key 900 that may be used to enable the key 122 of the keyboard 100. The key 900 may also be used in other devices utilizing keys, including keyboards other than the keyboard 100 and any other appropriate key-using device. The key 900 comprises a keycap 902 that is visible to users and configured to be pressed by users in a press direction as guided by a key guide 904. As will be explained in more detail below, in the embodiment of FIG. 9, when the keycap 902 is pressed, the keycap 902 moves in a direction with components along the press direction and also a second direction orthogonal to the press direction, as guided by the key guide 904.

Figure 10A:
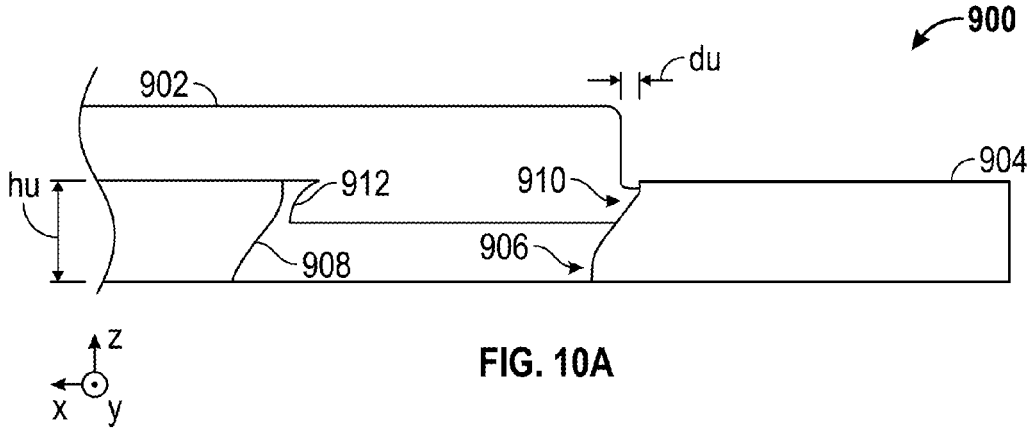
FIG. 10 A-B show simplified side views of the key of FIG. 9 taken along section line A-A according to an embodiment.
Figure 10B:
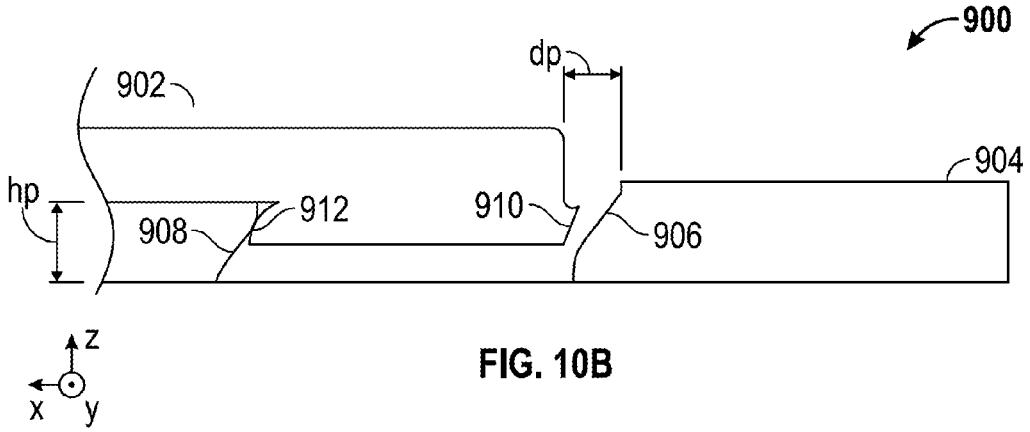

FIGS. 10A-B are sectional views (taken along section line B-B of FIG. 9) of the keycap 902 in the unpressed and pressed positions, respectively. The unpressed and pressed positions of the keycap 902 may be characterized by the vertical spacing between a bottom of the keycap 902 and a bottom of the key guide 904 and a lateral spacing between an edge of the keycap 902 and an arbitrary reference fixed relative to the key guide 904. The unpressed position is associated with the distances $h_u$ and $d_u$, and the pressed position is associated with the distances $h_p$ and $d_p$. Thus, the unpressed and pressed positions of the keycap 902 are separated in a press direction (negative-Z direction) by a first amount ($h_u$–$h_p$) and in a lateral direction (positive-X direction) by a second amount ($d_u$–$d_p$). The lateral direction is orthogonal to the press direction. These first and second amounts may have any ratio allowed by the physical constraints of the assembly. One may be many times the other, for example. In some embodiments, the first amount in the press direction is at least as much as the second amount in the lateral direction, and the first amount is no larger than twice the second amount.

As illustrated in FIGS. 10A-B, the key guide 904 includes ramp features 906 and 908 and the keycap 902 includes ramp contacting features 910 and 912. In operation, when a press force is applied to the keycap 902, the ramp contacting feature 910 moves down the ramp 906 toward the pressed position as illustrated in FIG. 9B. In the event that a user presses the keycap 902 in a manner that would cause the ramp contacting feature 910 to move away from the ramp 906 (and therefore be unguided by the ramp guide 904), the ramp contacting feature 912 comes into contact with the ramp 908 to guide the keycap 902 toward the pressed position. Upon removal of the press force, a ready/return mechanism (discussed below) causes the ramp contacting feature 912 moves along the ramp 908 toward the unpressed position.

Figure 11A:
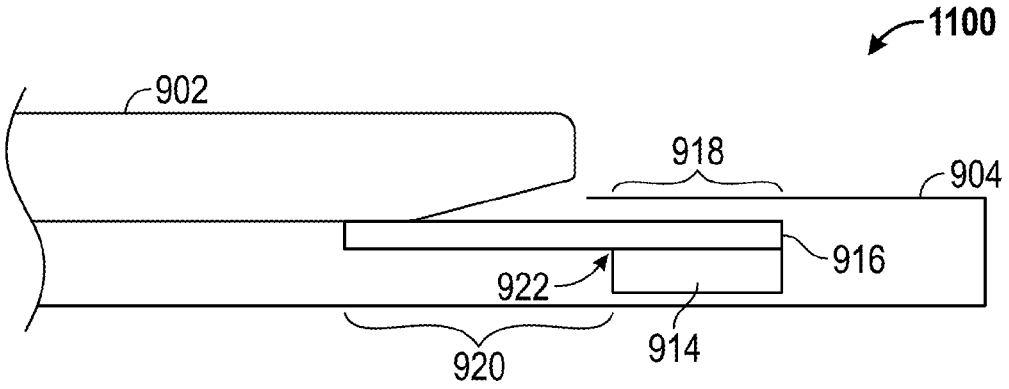
FIGS. 11A-B show simplified side views of the key of FIG. 9 taken along section line B-B according to an embodiment.
Figure 11B:
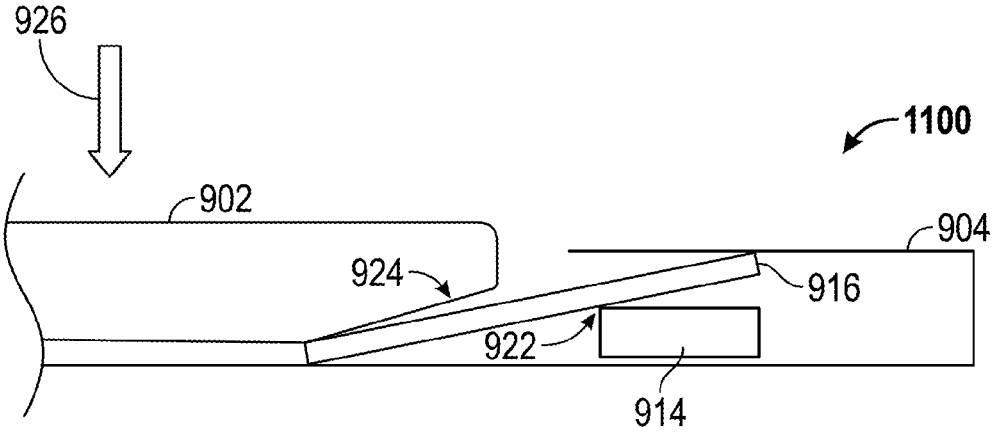

FIGS. 11A-B are sectional views (taken along section line C-C of FIG. 9) of a first embodiment of the key 900 with the keycap 902 in the unpressed and pressed positions. Specifically, FIGS. 11A-B show a key 1100 that may be used to enable the key 900. The key 1100 comprises a keycap 902 that is visible to users and configured to be pressed by users in a press direction. FIG. 11A illustrates a side view of the key 1100 in an unpressed position, where the keycap 902 is held (or supported) in a ready position by a keycap coupler 916. In the embodiment illustrated in FIG. 11A, the keycap coupler 916 is not physically attached to the keycap 902, and instead supports keycap 902 in a ready position. The keycap coupler 916 has a first portion 918 magnetically attracted to a magnet 914 held stationary with the key guide 904 (such as by being attached to the key guide 904). The keycap coupler 916 also has a second portion 920 that is cantilevered from the magnet 914 and supports the keycap 902.

In the exemplary embodiment of FIGS. 11A-B, the keycap coupler 916 and the magnet 914 form a magnetic hinge and provide the functions of a ready/return mechanism for the key 1100. In some embodiments, at least the first portion 918 of the keycap coupler 916 is a magnet of opposite polarity than the magnet 914 or includes a magnet. In some embodiments, at least the first portion 918 of the keycap coupler 916 or includes a ferrous material that is magnetically attracted to the magnet 914. In some embodiments, the second portion 920 of the keycap coupler 918 is also a magnet or ferrous material. In some embodiments, the second portion 920 of the keycap coupler 916 is made of a non-magnetic material. In some embodiments, the size or shape of the keycap coupler 916 or magnet 914 may be used to adjust or tune the breakover response, including the amount of required press force to operate the key 1100. As a non-limiting example, an edge of the keycap coupler 916 or magnet 914 may be beveled or chaffered at various angles at or near the pivot axis 922.

In FIG. 11B, a press force 926 is applied to the keycap 902 sufficient to overcome the magnetic attraction between the keycap coupler 916 and the magnet 914. When this occurs, the keycap coupler 916 pivots away from the magnet about a pivot axis 922 located closer to, or on, an edge of the magnet 914 closer to the keycap 902. The keycap coupler 916 moves away from the keycap 902 resulting in the keycap 902 translating with respect to the keycap coupler 916 as the keycap 902 moves toward the pressed position as guided by the key guide 904 as discussed in connection with FIGS. 10A-B. The keycap 902 includes a guide feature 924 that permits the keycap 902 to slide along the keycap coupler 916 if the keycap 902 contacts the keycap coupler 916 as it moves toward the pressed position. The magnetic attraction between the keycap coupler 916 and the magnet 914 provide a magnetic bias force that resists the press force 926, and when the press force 926 is reduced below the magnetic bias force or removed, the magnetic attraction between the keycap coupler 916 and the magnet 914 return the keycap 902 to the unpressed (ready) position as guided by the key guide 904.

Many variations of the magnetic hinge feature are contemplated and several exemplary embodiments are illustrated below. Although most of the embodiments discussed are presented in association with key assemblies and keyboards, they are readily applied to non-key-based touchsurface assemblies.

Figure 12A:
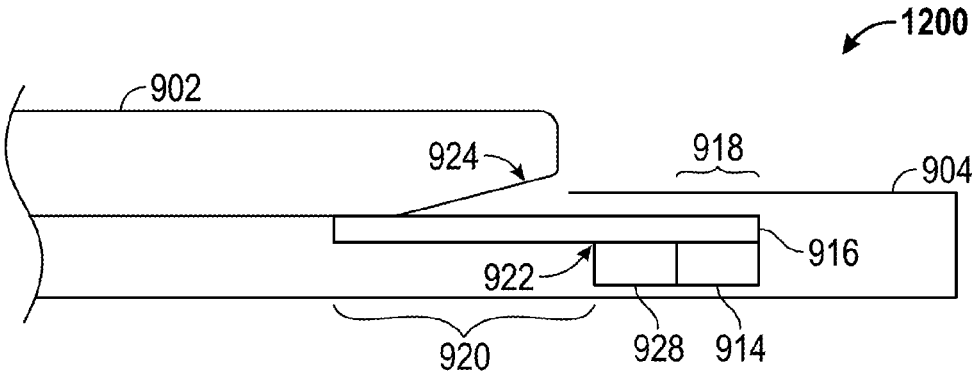
FIG. 12 A-B show simplified side views of the key of FIG. 9 taken along section line B-B according to an embodiment.
Figure 12B:
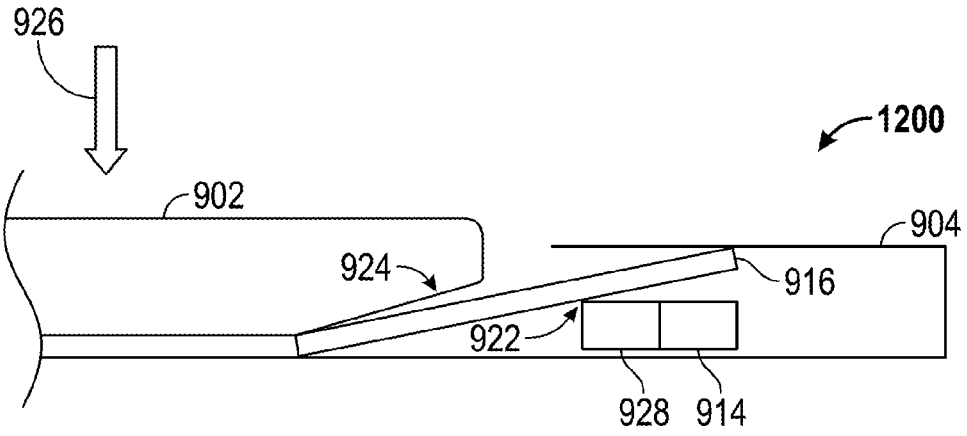

FIGS. 12A-B are sectional views (taken along section line B-B of FIG. 9) of a second embodiment of the key 900 with the keycap 902 in the unpressed and pressed positions. The key 1200 of FIGS. 12A-B differs from that described in FIGS. 11A-B by the inclusion of a component 928 positioned between the magnet 914 and the keycap 902. In response to the press force 926, the keycap coupler 916 pivots away from the magnet 914 about a pivot axis 922 that is located between the magnet 914 and the keycap 902 (or an edge thereof). The component 928 may be a non-magnetic component that helps to position the pivot axis 922 as desired for any particular implementation. In such an embodiment, the keycap coupler 916 separates from the magnet 914 in the pressed position due to the pivot axis 922 being between the keycap 902 and the magnet 914. In some embodiments, the component 928 may be a magnet having a magnetic field strength different than that of the magnet 914 for adjusting the magnetic bias of the ready/return mechanism of the key assembly 900. Additionally, the location, size, or shape of the component 928 may be used to adjust or tune the break-over response or the amount of required press force to operate the key 1200.

Figure 13A:
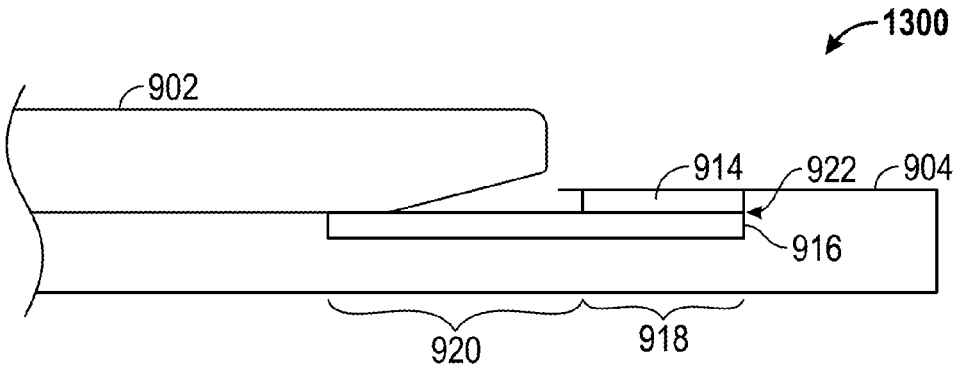
FIG. 13 A-B show simplified side views of the key of FIG. 9 taken along section line B-B according to an embodiment.
Figure 13B:
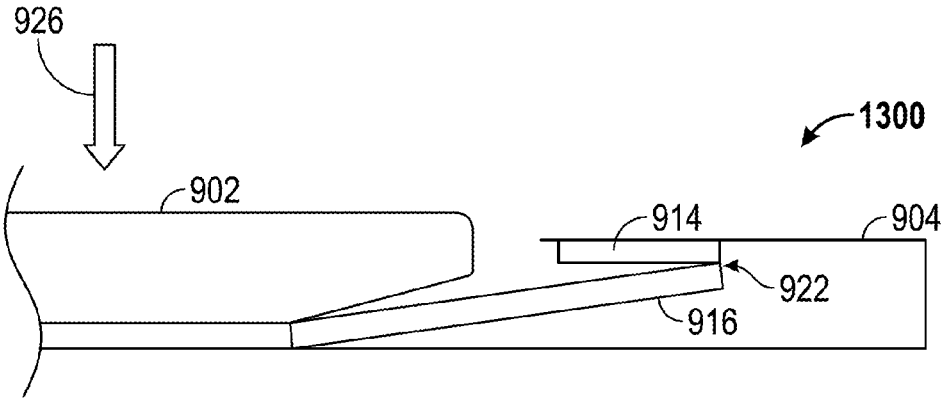

FIGS. 13A-B are sectional views (taken along section line C-C of FIG. 9) of a third embodiment of the key 1300 with the keycap 902 in the unpressed and pressed positions. The key 1300 of FIGS. 13A-B differ from that described in FIGS. 11A-B by the magnet 914 being positioned above the keycap coupler 916. In response to the press force 926, the keycap coupler 916 pivots away from the magnet 914 about a pivot axis 922 that is located on the magnet 914 that is closer to, or on, an edge of the magnet 914 further from the keycap 902.

Figure 14A:
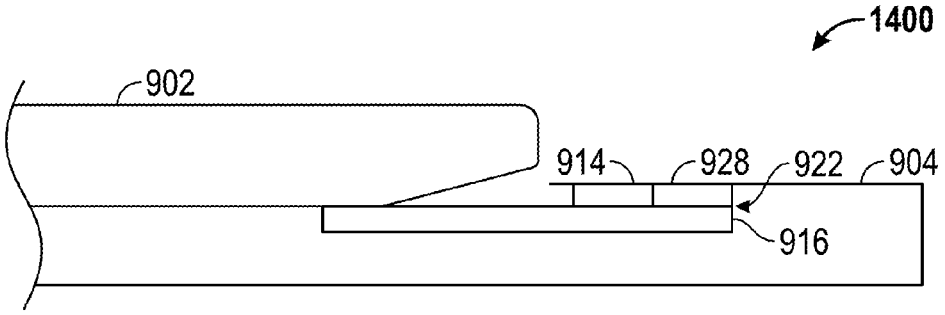
FIG. 14 A-B show simplified side views of the key of FIG. 9 taken along section line B-B according to an embodiment.
Figure 14B:
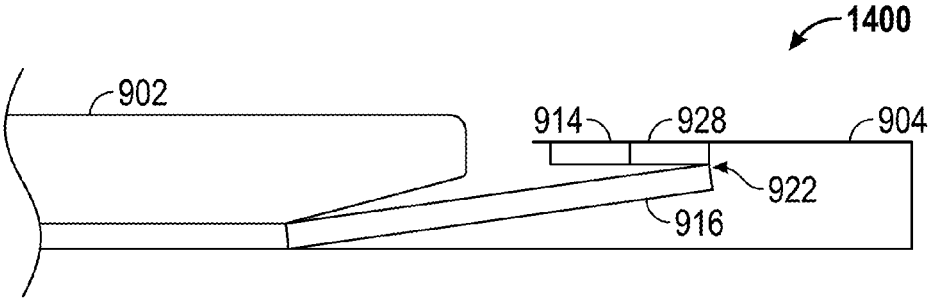

FIGS. 14A-B are sectional views (taken along section line C-C of FIG. 9) of a fourth embodiment of the key 900 with the keycap 902 in the unpressed and pressed positions. The key 1400 of FIGS. 14A-B differ from that described in FIGS. 13A-B by the inclusion of a component 928 positioned to cause the magnet 914 to be between the component 928 and the keycap 902. In response to the press force 926, the keycap coupler pivots away from the magnet about a pivot axis 922 that is located further away from the keycap 902. In this embodiment, the magnet is positioned between the keycap 902 (or an edge thereof) and the pivot axis 922. The component 928 may be a non-magnetic component to move or position the pivot axis 922 as desired for any particular implementation. In such an embodiment, the keycap coupler 916 separates from the magnet 914 in the pressed position due to the pivot axis 922 being off the magnet 914. In some embodiments, the component 928 may be a magnet that contributes to the magnetic forces of the ready/return mechanism of the key 1400.

It will be appreciated that each of the key assemblies of FIGS. 11-14 have been illustrated in simple block cross-section form to facilitate understanding. More complex cross-section forms are contemplated, including, without limitation, having the magnet (e.g., 914) incorporated in whole or in part into the base (e.g., 904). In some embodiments, the magnet (e.g., 914) could be incorporated in whole or in part into the component (e.g., 928) or partially in the component and partially in the base. Still other embodiments contemplate the addition of a protective layer or film disposed between the magnet (e.g., 914) and the keycap coupler (e.g., 916) to reduce wear on the magnet surface due to repeated uncoupling and recoupling to the keycap coupler.

Figure 15:
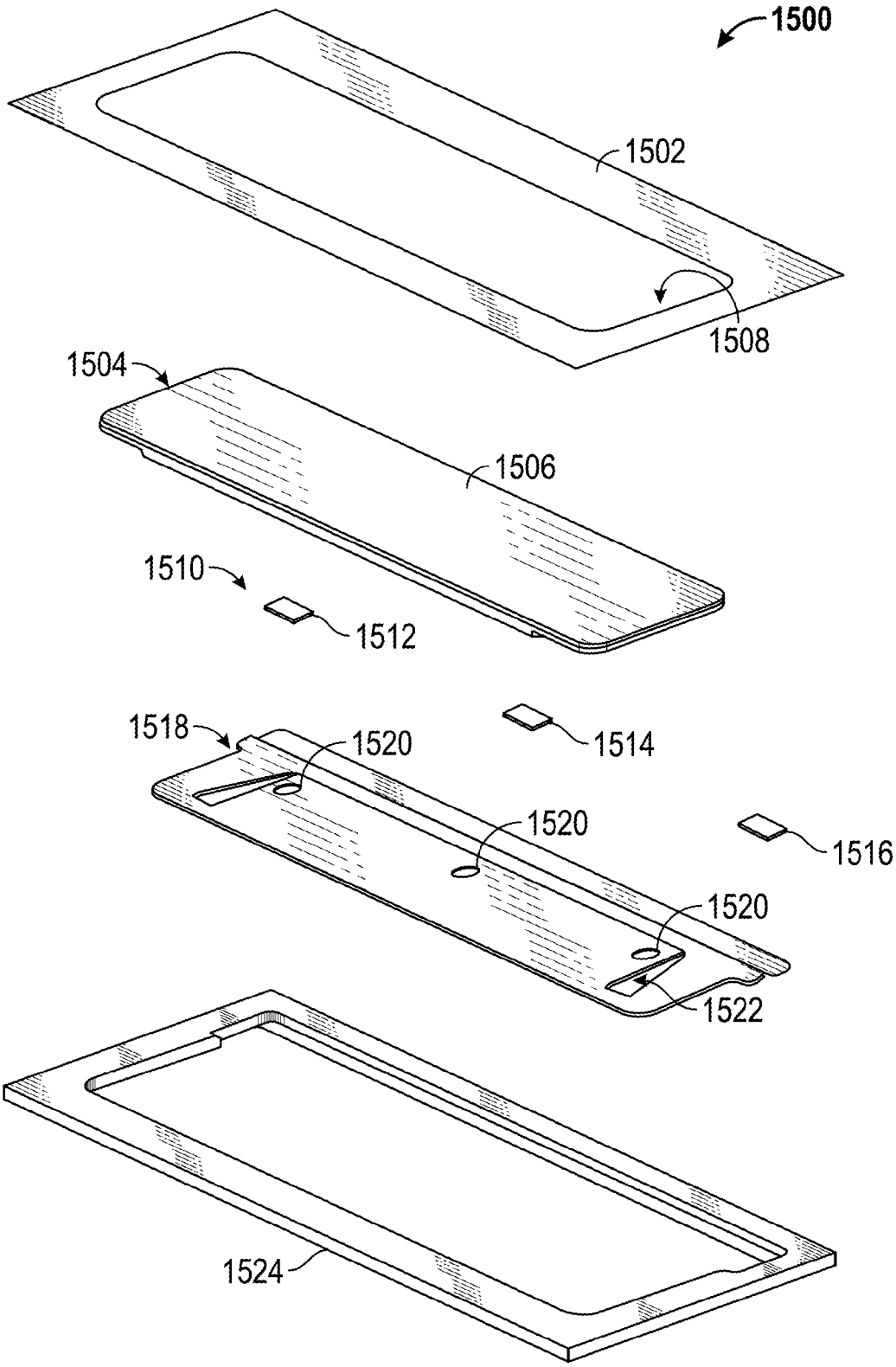
FIG. 15 shows an exploded view of a key assembly according to an embodiment.

FIG. 15 illustrates an exploded, perspective view of a key assembly 1500. Some embodiments of the key assembly 1500 are found in assemblies with wider touchsurfaces, longer touchsurfaces, or touchsurfaces having large aspect ratios or complex shapes. For example, space bars of some keyboard designs, which often have width-to-length aspect ratios of 4:1 to 7:1 may utilize the magnet hinge feature of FIG. 15. The key assembly 1500 includes a bezel 1502 into which a keycap 1504 having a touch surface 1506 is positioned in an aperture 1508.

The key assembly 1500 includes a magnet array 1510 (which includes magnets 1512, 1514 and 1516) interposed between the bezel 1502 and the keycap coupler 1518. The magnet array 1510 is magnetically attracted to the bezel 1502 and the keycap coupler 1518. Alternatively, the magnet array 1508 may be rigidly attached to the keycap coupler 1518 through any appropriate method (e.g., through use of retaining features, press fits, adhesives, fasteners, or any other appropriate technique). The magnetic coupling between the keycap coupler 1518 and the magnet array 1510 suspends (or supports) the keycap coupler 1518 in the aperture 1508 of the bezel 1502. In this embodiment, the keycap coupler 1518 is coupled to the keycap 1504 using apertures 1520 in the keycap coupler 1518. In some embodiments, the keycap coupler 1518 has an elongated cut-out 1522 that surround most of the interior region. This cut-out 1522 may have a variety of functions. In some embodiments, the cut-out 1522 deforms in response to press force to provide an anti-rotation function that helps keep the keycap 1502 more level during travel toward the pressed position. In some embodiments, the cut-out 1522 helps transmit the press force more evenly to the magnetic hinge feature.

Figure 16:
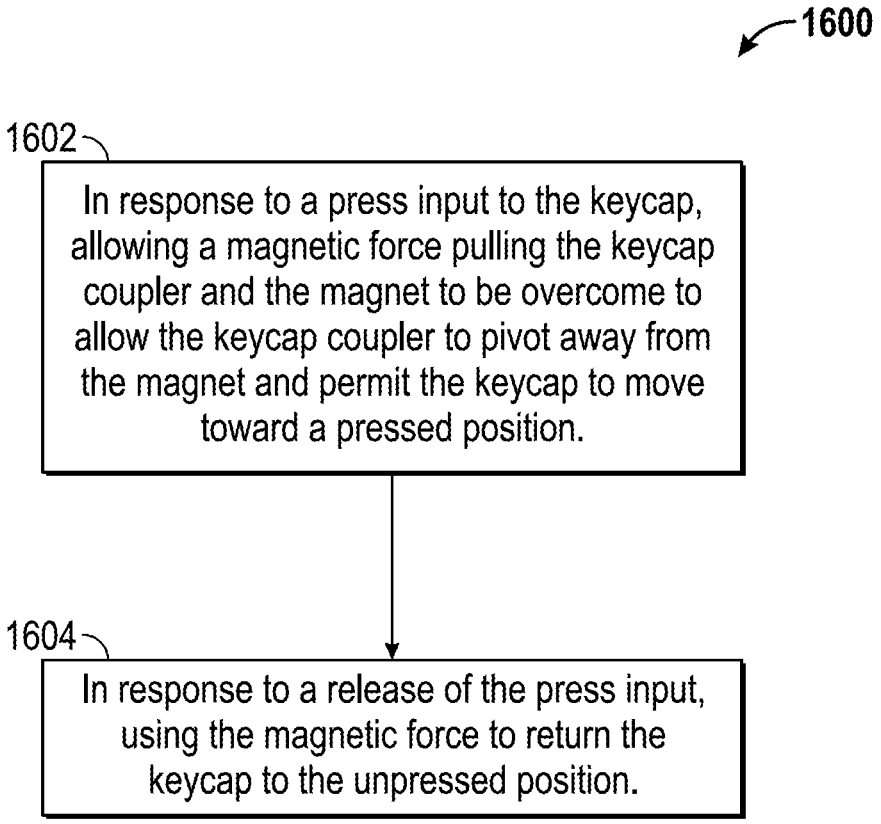
FIG. 16 is flow chart illustrating a method that can be used for affecting motion of a pressable touchsurface of an example touchsurface assembly.

FIG. 16 shows an example method 1600 that can be used for effecting motion of a pressable touchsurface of a touchsurface assembly, such as, in some embodiments, the keycap of a key assembly. The pressable touchsurface is configured to move between an unpressed position and a pressed position relative to a base of the key assembly, where the unpressed and pressed positions are separated in a press direction and in a lateral direction orthogonal to the press direction.

Step 1602 comprises allowing a magnetic force attracting the keycap coupler and the magnet to be overcome in response to a press input to the keycap to allow the keycap coupler to pivot away from the magnet and permit the keycap to move toward a pressed position.

Step 1604 comprises, using the magnetic force to return the keycap to the unpressed position in response to a release of the press input.

Thus, the techniques described herein can be used to implement any number of devices utilizing different touchsurface assemblies, including a variety of keyboards each comprising one or more key assemblies in accordance with the techniques described herein. For example, some embodiments of keyboards comprises a base, a plurality of key assemblies, and a key sensor. The key sensor is configured to detect pressed states of one or more keycaps of the plurality of key assemblies. At least one key assembly of the plurality of key assemblies comprises a keycap, a base and an magnetic hinge ready/return mechanism. In some embodiments, the keycap is configured to move between an unpressed position and a pressed position relative to the base, where the unpressed and pressed positions are separated vertically (in a press direction) and laterally (in a second direction orthogonal to the press direction).

The implementations described herein are meant as examples, and many variations are possible. As one example, any appropriate feature described with one implementation may be incorporated with another. As a first specific example, any of the implementations described herein may or may not utilize a finishing tactile, aesthetic, or protective layer.

In addition, the structure providing any function may comprise any number of appropriate components. For example, a same component may provide leveling, planar translation effecting, readying, and returning functions for a key press. As another example, different components may provide these functions, such that a first component levels, a second component effects planar translation, a third component readies, and a fourth component returns. As yet another example, two or more components may provide a same function. For example, in some embodiments, magnets and springs together provide the return function, or the ready and return functions.

What is claimed is:

1. A key assembly comprising:

a base;

a keycap;

a magnet physically coupled to the base near to the keycap; and a keycap coupler having a first portion magnetically coupled to the magnet and a second portion cantilevered from the magnet and supporting the keycap in an unpressed position, wherein the second portion of the keycap coupler includes a section that extends through an opening in the base, wherein the second portion of the keycap coupler is longer than the first portion of the keycap coupler, and wherein when a press force applied to the keycap overcomes a magnetic force pulling the keycap coupler toward the magnet, the keycap coupler pivots away from the magnet to allow the keycap to move toward a pressed position.

2. The key assembly of claim 1, wherein upon a release of the press force, the magnetic force attracts the keycap coupler and returns the keycap to the unpressed position.

3. The key assembly of claim 1, wherein all or part of the first portion of the keycap coupler comprises a magnetic or a non-magnetized ferrous material.

4. The key assembly of claim 1, wherein the magnet and the first portion of the keycap coupler are disposed on a same side of the base.

5. The key assembly of claim 1, wherein the keycap coupler pivots away from the magnet by pivoting on the magnet.

6. The key assembly of claim 1, wherein the keycap coupler pivots away from the magnet by pivoting about an axis located between the magnet and an edge of the keycap.

7. The key assembly of claim 1, wherein the keycap coupler pivots away from the magnet by pivoting about an axis, wherein the magnet is located between an edge of the keycap and the axis.

8. The key assembly of claim 1, wherein the keycap coupler pivots away from the magnet to allow the keycap to move toward the pressed position by pivoting into a configuration that allows the keycap to translate relative to the keycap coupler toward the pressed position.

9. The key assembly of claim 8, further comprising:

a key guide coupled to the base and configured to guide the keycap toward the pressed position responsive to the press force;

wherein when the press force overcomes the magnetic force pulling the keycap coupler toward the magnet, the keycap coupler pivots away from the magnet to allow the keycap to move toward the pressed position as guided by the key guide in a first direction and a second direction orthogonal to the first direction.

10. The key assembly of claim 1, further comprising:

a second magnet physically coupled to the base and spaced apart from the magnet along a first side of the keycap, wherein the first portion of the keycap coupler is magnetically coupled to the second magnet, wherein when the press force overcomes the magnetic force pulling the keycap coupler toward the magnet and a second magnetic force pulling the keycap coupler toward the second magnet, the keycap coupler pivots away from both the magnet and the second magnet to allow the keycap to move toward the pressed position.

11. The key assembly of claim 1, wherein the keycap is attached to the keycap coupler, and wherein the keycap coupler pivots away from the magnet to allow the keycap to move toward the pressed position by causing the keycap to rotate with the keycap coupler to toward the pressed position.

12. The key assembly of claim 1, wherein the keycap coupler has an elongated cut-out that facilitates deformation of the keycap coupler as the keycap moves toward the pressed position.

13. A keyboard, comprising:

a base;

a plurality of keycaps;

a plurality of magnets, each magnet of the plurality of magnets physically coupled to the base near a respective keycap of the plurality of keycaps; and a plurality of keycap couplers, each keycap coupler of the plurality of keycap couplers having a first portion magnetically coupled to a respective magnet of the plurality of magnets and a second portion cantilevered from the respective magnet and supporting the respective keycap in a respective unpressed position, wherein the second portion of the keycap coupler includes a section that extends through an opening in the base, wherein, for each keycap coupler of the plurality of keycap couplers, the second portion of the keycap coupler is longer than the first portion of the keycap coupler, and wherein, for each keycap coupler of the plurality of keycap couplers, when a press force applied to the respective keycap overcomes a respective magnetic force pulling the keycap coupler to the respective magnet, the keycap coupler pivots away from the respective magnet to allow the respective keycap to move toward a respective pressed position.

14. The key assembly of claim 13, wherein each keycap coupler pivots away from the respective magnet by pivoting on the respective magnet.

15. The keyboard of claim 13, wherein a keycap coupler of the plurality of keycap couplers pivots away from the respective magnet to allow the respective keycap to move toward the respective pressed position by pivoting into a configuration that allows the respective keycap to translate relative to the keycap coupler toward the respective pressed position.

16. The keyboard of claim 13, wherein the first portion of a keycap coupler of the plurality of keycap couplers is magnetically coupled to two respective magnets of the plurality of magnets, and wherein upon a release of the press force applied to the respective keycap, the respective magnetic forces pulling the keycap coupler toward the two respective magnets causes the keycap coupler to move the respective keycap to the unpressed position.

17. A method of effecting motion of a keycap of a key assembly, wherein the keycap is supported in an unpressed position by a keycap coupler having a first portion magnetically coupled to a magnet and a second portion cantilevered from the magnet and supporting the keycap in the unpressed position, the method comprising:

in response to a press input to the keycap, allowing a magnetic force pulling the keycap coupler and the magnet to be overcome to allow the keycap coupler to pivot away from the magnet and permit the keycap to move toward a pressed position; and in response to a release of the press input, using the magnetic force to return the keycap to the unpressed position, wherein the second portion of the keycap coupler includes a section that extends through an opening in the base, and wherein the second portion of the keycap coupler is longer than the first portion of the keycap coupler.

18. The method of claim 17, wherein the key assembly further comprises a key guide coupled to a base, the method further comprising:

guiding the keycap with the key guide in a first direction and a second direction orthogonal to the first direction as the keycap moves toward the pressed position.

19. The key assembly of claim 1, further comprising a component that is separate from the magnet and disposed laterally from the magnet, wherein the key coupler pivots on the component.

20. The key assembly of claim 1, wherein the magnet is disposed below the key coupler, and wherein the key coupler pivots on the magnet.

* * * * *